US009896749B2

(12) United States Patent
Hashimura et al.

(10) Patent No.: US 9,896,749 B2
(45) Date of Patent: Feb. 20, 2018

(54) STEEL FOR INDUCTION HARDENING WITH EXCELLENT FATIGUE PROPERTIES

(71) Applicant: NIPPON STEEL & SUMITOMO METAL CORPORATION, Tokyo (JP)

(72) Inventors: Masayuki Hashimura, Tokyo (JP); Masafumi Miyazaki, Tokyo (JP); Takashi Fujita, Tokyo (JP); Hideaki Yamamura, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 413 days.

(21) Appl. No.: 14/423,754

(22) PCT Filed: Oct. 18, 2013

(86) PCT No.: PCT/JP2013/078324
§ 371 (c)(1),
(2) Date: Feb. 25, 2015

(87) PCT Pub. No.: WO2014/061782
PCT Pub. Date: Apr. 24, 2014

(65) Prior Publication Data

US 2015/0203943 A1 Jul. 23, 2015

(30) Foreign Application Priority Data

Oct. 19, 2012 (JP) ..... 2012-232141

(51) Int. Cl.

| | |
|---|---|
| ***C22C 38/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/40*** | (2006.01) |
| ***C21C 7/064*** | (2006.01) |
| ***C21C 7/10*** | (2006.01) |
| *C21D 9/40* | (2006.01) |

(52) U.S. Cl.

CPC ..... *C22C 38/14* (2013.01); *C21C 7/064* (2013.01); *C21C 7/10* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/40* (2013.01); *C21D 9/40* (2013.01); *C21D 2211/004* (2013.01)

(58) Field of Classification Search

CPC ..... C22C 38/14; C22C 38/06; C22C 38/04; C22C 38/02; C22C 38/005; C22C 38/002; C22C 38/001

See application file for complete search history.

(56) References Cited

U.S. PATENT DOCUMENTS 6,120,578 A 9/2000 Nakato et al.

FOREIGN PATENT DOCUMENTS

| | | | |
|---|---|---|---|
| CN | 1185813 | 6/1998 | |
| CN | 1759199 | 4/2006 | |
| CN | 101960035 | 1/2011 | |
| EP | 1865079 A1 * | 12/2007 | ..... C21D 8/065 |
| JP | 09-263820 | 10/1997 | |
| JP | 11-279695 | 10/1999 | |
| JP | 2002-069566 | 3/2002 | |
| JP | 2004-277777 | 10/2004 | |
| JP | 2011-111668 | 6/2011 | |
| JP | 2011-168842 | 9/2011 | |
| WO | 2004081250 | 9/2004 | |
| WO | WO 2013/061652 | 5/2013 | |

OTHER PUBLICATIONS

Office Action dated Feb. 3, 2016 issued in related Chinese Application No. 201380045124.5 [with English Translation].

International Search Report dated Dec. 3, 2013 issued in corresponding PCT Application No. PCT/JP2013/078324 [with English Translation].

* cited by examiner

*Primary Examiner* — Jessee Roe

(74) *Attorney, Agent, or Firm* — Birch, Stewart, Kolasch & Birch, LLP

(57) ABSTRACT

A steel for induction hardening includes as a chemical composition, by mass %, C: 0.45% to 0.85%, Si: 0.01% to 0.80%, Mn: 0.1% to 1.5%, Al: 0.01% to 0.05%, REM: 0.0001% to 0.050%, O: 0.0001% to 0.0030%. Ca: 0.0050% or less as necessary, Ti: less than 0.005%, N: 0.015% or less, P: 0.03% or less, S: 0.01% or less, and the balance consists of Fe and impurities. The steel for induction hardening also includes a composition inclusion which is an inclusion containing REM, O, S, and Al, or an inclusion containing REM, Ca, O, S, and Al, to which TiN is adhered.

3 Claims, 2 Drawing Sheets

STEEL FOR INDUCTION HARDENING WITH EXCELLENT FATIGUE PROPERTIES

TECHNICAL FIELD OF THE INVENTION

This application is a national stage application of International Application No. PCT/JP2013/078324, filed on Oct. 18, 2013, which claims priority to Japanese Patent Application No. 2012 -232141, filed on Oct. 19, 2012, each of which is incorporated by reference in its entirety.

The present invention relates to steel for induction hardening in which a non-metal inclusion is finely dispersed, and which is with excellent fatigue properties, and more particularly, to steel for induction hardening in which generation of a REM inclusion is controlled for removing a bad effect of a harmful inclusion such as TiN and MnS, and which has satisfactory fatigue properties.

RELATED ART

Steel for induction hardening is used as a rolling bearing such as a "ball bearing" and a "roller hearing" which are used in various kinds of industrial machines, vehicles, and the like, and a rolling member such as a gear. In addition, recently, steel for induction hardening is also used in bearings or sliding members in electronic equipment that drives a hard disk used in a hard disk drive which is a magnetic recording medium, household electric appliances or instruments, medical equipment, and the like.

The steel for induction hardening that is used in the rolling member or the sliding member is demanded to have excellent fatigue properties. However, when inclusions are contained in the steel for induction hardening, an increase in the number of inclusions and an increase in the size of inclusions have an adverse effect on fatigue life. Accordingly, in order to improve the fatigue properties, it is necessary to make the inclusions as small as possible and to decrease the number thereof.

As inclusions contained in the steel for induction hardening, inclusions made of an oxide such as alumina ($Al_2O_3$), a sulfide such as manganese sulfide (MnS), and a nitride such as titanium nitride (TiN) are known.

An aluminum-based inclusion is generated when dissolved oxygen that remains in a large amount in molten steel refined by a converter or a vacuum processing vessel is bonded to Al with a strong affinity with oxygen. In addition, a ladle and the like are constructed by an alumina-based refractory in many cases. Accordingly, during deoxidation, alumina is eluted as Al in molten steel due to a reaction between molten steel and the refractory, and is re-oxidized to an alumina-based inclusion.

Accordingly, reduction and removal of the alumina-based inclusion are performed by a combination of (1) prevention of re-oxidation due to deaeration, slag reforming and the like, and (2) reduction of a mixed-in oxide-based inclusion caused by slag-cutting through the application of a secondary refining apparatus such as a RH degasser and a powder blowing apparatus.

In addition, with regard to a method of manufacturing Al-killed steel that contains 0.005% by mass or more of acid-soluble Al, an alloy composed of two or more kinds of elements selected from Ca, Mg, and REM, and Al is added to the molten steel. Therefore, a method of manufacturing alumina cluster free Al-killed steel through adjusting the amount of $Al_2O_3$ in a generated inclusion to a range of 30% to 85% by mass is known.

For example, as disclosed in Patent Document 1, a method, in which two or more kinds of elements selected from REM, Mg, and Ca, are added to molten steel to form an inclusion with a low melting point so as to prevent generation of an alumina, cluster, is known. This method is effective at preventing sliver flaws. However, in this method, it is difficult to make the size of the inclusion small to a level that is demanded for the steel for induction hardening. The reason is that inclusions with a low melting point are aggregated and integrated, and thus the inclusion tends to he relatively coarsened.

REM is an element that spheroidizes an inclusion and improves fatigue properties. REM is added to molten steel as necessary, but when REM is excessively added, the number of inclusions increases, and thus a fatigue life that is one of the fatigue properties deteriorates. For example, as described in Patent Document 2, it is also known that it is necessary to set the amount of REM to 0.010% by mass or less in order to not decrease the fatigue life. However, Patent Document 2 does not disclose a mechanism for decreasing the fatigue life and a state that the inclusion exists.

In addition, when an inclusion made of a sulfide such as MnS is stretched by a process such as forging, it may become a place where fatigue accumulates as a starting point of fracture, and deteriorate the fatigue properties of the steel. Accordingly, to improve the fatigue properties, it is necessary to control the number of the sulfide inclusions and the size thereof.

On the other hand, REM is coupled to oxygen to form an oxide, and is coupled to sulfur to form a sulfide. In addition, when the amount of REM is greater than the amount of REM that is coupled to oxygen, a sulfide is generated and the size of the inclusions increases, and thus REM has an adverse effect on the fatigue properties. To prevent this adverse effect, it is necessary to control the size of the inclusions.

To control the size of the inclusions, it is necessary to add REM in an amount appropriate for the amount of oxygen in the steel. Before adding an appropriate amount of REM to the steel, it is preferable to reduce the amount of oxygen present in the steel. In addition, sulfide inclusions in the steel are one type of inclusion that decreases fatigue life of the steel for induction hardening, and thus it is preferable to prevent the generation of coarse sulfides, and in particular MnS. For this reason, it is preferable that the amount of sulfur in the steel be reduced, and then that an appropriate amount of REM be added to the steel for the amount of sulfur present in order to generate an oxysulfide, thus, generation of MnS can be suppressed. That is, it is preferable to add an amount of REM appropriate for the amounts of both oxygen and sulfur However, this technical idea is not disclosed in Patent Document 2 or the like.

In addition, as a method of preventing generation of a sulfide, a method in which Ca is added for desulfurization is known. However, although the addition of Ca is effective for preventing the generation of sulfide, it is not effective at preventing the generation of TiN, which is a nitride.

As shown in FIG. 2, TiN is very hard, and crystalizes or precipitates in steel in a sharp shape. According to this, TiN becomes a place where fatigue accumulates source as a starting point of fracture, and has an adverse effect on the fatigue properties. For example, as disclosed in Patent Document 3, when the amount of Ti exceeds 0.001% by mass, the fatigue properties deteriorate. As a countermeasure thereof, it is important to adjust the amount of Ti to 0.001% by mass or less, but Ti is also contained in hot metal or slag, and thus it is difficult to avoid mixing-in of Ti as an impurity. Accordingly, it is difficult to stably reduce Ti to a desired level.

Accordingly, it is necessary to reduce the amount of Ti and N or to remove them in a molten steel. However, this results in an increase in the costs of steel-making, and is not preferable. In addition, an Al—Ca—O-based inclusion that is formed due to addition of Ca has a problem in that it tends to be stretched, and tends to be a place where fatigue accumulates as a starting point of fractures.

PRIOR ART DOCUMENT

Patent Document

[Patent Document 1] Japanese Unexamined Patent Application, First Publication No. H09-263820

[Patent Document 2] Japanese Unexamined Patent Application, First Publication No. H11-279695

[Patent Document 3] Japanese Unexamined Patent Application, First Publication No. 2004-277777

DISCLOSURE OF THE INVENTION

Problems to be Solved by the Invention

The invention has been made in consideration of the problems in the related art, and an object thereof is to provide steel for induction hardening with excellent fatigue properties by detoxifying TiN, an Al—O-based inclusion, Al—Ca—O-based inclusion, and MnS which tend to be where fatigue accumulates as a starting point of fractures.

Means for Solving the Problem

The gist of the invention is as follows.

(1) According to a first aspect of the invention, a steel for induction hardening includes as a chemical composition, by mass %: C: 0.45% to 0.85%, Si: 0.01% to 0.80%, Mn: 0.1% to 1.5%. Al: 0.01% to 0.05%, REM: 0.0001% to 0.050%, O: 0.0001% to 0.0030%, Ti: less than 0.005%, N: 0.015% or less, P: 0.03% or less, S: 0.01% or less, and the balance consists of Fe and impurities. The steel for induction hardening includes a composite inclusion which is an inclusion containing REM, O, S, and Al, to which TiN is adhered. The sum of the number density of TiN having a maximum diameter of 1 μm or more which independently exists without adhesion to the inclusion, and the number density of MriS having a maximum diameter of 10 μm or more, is 5 pieces/mm$^2$ or less.

(2) According to a second aspect of the invention, a steel for induction hardening includes as a chemical composition, by mass % C: 0.45% to 0.85%, Si: 0.01% to 0.80%, Mn: 0.1% to 1.5%, Al: 0.01% to 0.05%, Ca: 0.0050% or less, REM: 0.0001% to 0.050%, O: 0.0001% to 0.0030%. Ti: less than 0.005%, N: 0.015% or less, P: 0.03% or less, S: 0.01% or less, and the balance consists of Fe and impurities. The steel for induction hardening includes a composite inclusion which is an inclusion containing REM, Ca, O, S. and Al, to which TiN is adhered. The sum of the number density of TiN having a maximum diameter of 1 μm or more which independently exists without adhesion to the inclusion, and the number density of MnS having a maximum diameter of 10 μm or more, is 5 pieces/mm$^2$ or less.

(3) The steel for induction hardening according to (1) or (2) further includes as the chemical composition, one or more kinds of elements selected from the group consisting of, by mass %, Cr: 2.0% or less, V: 0.70% or less, Mo: 1.00% or less, W: 1.00% or less, Ni: 3.50% or less, Cu: 0.50% or less, Nb: less than 0.050%, and B: 0.0050% or less.

Effects of the Invention

According to the aspects of the invention, an Al—O-based inclusion is reformed into a REM-Al—O-based inclusion, or an Al—Ca—O-based inclusion is reformed into a REM-Ca—Al—O-based inclusion, and thus it is possible to prevent stretching or coarsening of the oxide-based inclusion. In addition, S is fixed to the REM-Al—O-based inclusion or the REM-Ca—Al—O-based inclusion to form a REM-Al—O—S-based inclusion or a REM-Ca—Al—O—S-based inclusion, and thus it is possible to suppress generation of coarse MnS. In addition, TiN is adhered to the REM-Al—O—S-based inclusion or the REM-Ca—Al—O—S-based inclusion to form a composite inclusion, thereby reducing a number density of TiN that independently exists without adhesion to the inclusion. Accordingly, it is possible to provide steel for induction hardening with excellent fatigue properties, particularly with excellent fatigue life.

EMBODIMENTS OF THE INVENTION

Figure 1:
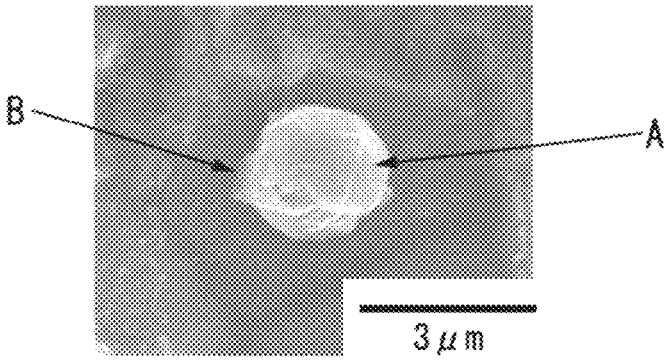
FIG. 1 is a view showing a form of an inclusion (composite inclusion) in which REM-Al—O—S-based inclusion and TiN forms a composite.

The present inventors have performed a thorough experiment and have made a thorough investigation to solve the problems in the related art. As a result, the present inventors have obtained the following finding, by adjusting the amount of REM in the steel and by adding the amount of Ca to the steel correspond to the amount of REM, and by controlling a deoxidation process.

(1) When an Al—O-based inclusion, which is an oxide, is reformed into a REM-Al—O-based inclusion, or an Al—Ca—O-based inclusion, which is au oxide, is reformed into a REM-Ca—Al—O-based inclusion, it is possible to prevent stretching or coarsening of an oxide-based inclusion.

(2) When S is fixed to the REM-Al—O-based inclusion that is an oxide or the REM-Ca—Al—O-based inclusion that is an oxide for being reformed into a REM-Al—O—S-based inclusion that is an oxysulfide or a REM-Ca—Al—O—S-based inclusion that is an oxysulfide, it is possible to suppress generation of coarse MnS.

(3) When TiN is adhered to the REM-Al—O—S-based inclusion that is an oxysulfide or the REM-Ca—Al—O—S-based inclusion that is an oxysulfide, it is possible to reduce the number density of single TiN that independently exists without adhesion.

Hereinafter, steel for induction hardening and a method of manufacturing the same according to an embodiment of the invention made on the basis of the above-described findings will be described in detail.

First, a chemical composition of the steel for induction hardening according to this embodiment and the reason why the chemical composition is limited will be described. In addition, % relating to the amount of each of the following elements represents mass %.

C: 0.45% to 0.85%

C is an element that secures hardness by induction hardening and improves a fatigue life. To secure strength and hardness by induction hardening, it is necessary for the steel to contain 0.45% or more of C. However, when the amount of C exceeds 0.85%, hardness is excessively increased, and this the tool service life during cutting decreases and C becomes a cause of a quenching crack. Accordingly, the amount of C is set to 0.45% to 0.85%, is preferably set to more than 0.45% and 0.85% or less, and is more preferably set to 0.50% to 0.80%.

Si: 0.01% to 0.80%

Si is an element that increases hardenability and improves fatigue life. To attain this effect, it is necessary for the steel to contain 0.01% or more of Si. However; when the amount of Si exceeds 0.80%, the effect that the hardenability is improved is saturated and hardness of a base metal is increased. Therefore, the tool service life during cutting decreases. Accordingly, the amount of Si is set to 0.01% to 0.80%, and is preferably 0.07% to 0.65%.

Mn: 0.1% to 1.5%

Mn is an element that increases the strength by increasing the hardenability, and improves fatigue life. To attain this effect, it is necessary for the steel to contain 0.1% or more of Mn. However; when the amount of Mn exceeds 1.5%, the effect that the hardenability is improved is saturated and hardness of the base metal is increased. Therefore, a tool service life during cutting decreases. In addition, when the amount of Mn exceeds 1.5%, hardness of the base metal increases, and thus Mn becomes a cause of a quenching crack. Accordingly, the amount of Mn is set to 0.1% to 1.5%, and is preferably set to 0.2% to 1.15%.

Al: 0.01% to 0.05%

Al is a deoxidizing element that reduces the total oxygen amount (T.O), and is an element that can be used to adjust a grain size of steel. Therefore, it is necessary for the steel to contain 0.01% or more of Al.

However, when the amount of Al is large, $Al_2O_3$ becomes more stable than the REM-Al—O-based inclusions or the REM-Ca—Al—O-based inclusions which are oxide-based inclusions, or the REM,M-O—S-based inclusion or the REM-Ca—Al—O—S-based inclusion which are oxysulfide-based inclusions, and thus it is considered that it is difficult to reform $Al_2O_3$ into REM-Al—O-based inclusions or REM-Ca—Al—O-based inclusions which are oxide-based inclusion, or into the REM-Al—O—S-based inclusions or REM-Ca—Al—O—S-based inclusions Which are oxysulfide-based inclusions. Accordingly, the amount of Al is set to 0.05% or less.

REM: 0.0001% to 0.050%

REM is a strong desulfiirizing and deoxidizing element, and plays a very important role in the steel for induction hardening according to this embodiment. Here, REM is a general term of a total of 17 elements including 15 elements from lanthanum with an atomic number of 57 to lutetium with an atomic number of 71, scandium with an atomic number of 21, and yttrium with an atomic number of 39.

First, REM reacts with $Al_2O_3$ in the steel to separate O of $Al_2O_3$, thereby generating the REM-Al—O-based inclusion that is an oxide-based inclusion. Then, in a case where Ca is added to the steel. REM reacts with Ca to generate the REM-Ca—Al—O-based inclusions that is an oxide-based inclusion. In addition, the above-described oxide attracts S in the steel to generate REM-Al—O—S-based inclusions that is an oxysulfide-based inclusion containing REM, O, S, and Al. In addition, in a case where an oxide containing Ca exists, a REM-Ca—Al—O—S-based inclusion that is an oxysulfide-based inclusion containing REM, Ca, O, S, and Al is generated. In addition, in the REM-Ca—Al—O—S-based inclusions that is an oxysulfide-based inclusion, Ca does not exist as CaS independently from the oxysulfide, but forms a solid solution in the REM-Ca—Al—O—S-based inclusions.

Functions of REM in the steel for induction hardening according to this embodiment are as follows. REM reforms $Al_2O_3$ into REM-Al—O-based inclusions containing REM, O, and Al, thereby preventing coarsening of an oxide. In a case Where Ca is added to the steel. REM reforms $Al_2O_3$ into the REM-Ca—Al—O-based inclusions, thereby preventing coarsening of an oxide. In addition. REM fixes S through formation of REM-Al—O—S-based inclusions containing Al, REM, O, and S, or REM-Ca—Al—O—S-based inclusions containing Al, REM, Ca, O, and S, and suppresses generation of coarse MnS. In addition, REM generates TiN using the REM-Al—O—S-based inclusions or the REM-Ca—Al—O—S-based inclusions as a nucleus, thereby forming an approximately spherical composite inclusion having a main structure of REM-Al—O—S—(TiN) or REM-Ca—Al—O—S—(TiN).

For example, as shown in FIG. 1, the approximately spherical composite inclusion has a form to which TiN adheres. In addition, it can be seen that the approximately spherical composite inclusions have a volume much larger than that of TiN. In addition, an amount of precipitation of TiN, which independently exists without adhesion to the REM-Al—O—S-based inclusions or the REM-Ca—Al—O—S-based inclusions and which is hard and has a sharp angular shape, is reduced. Here, (TiN) represents that TiN adheres to a surface of the REM-Al—O—S-based inclusions or the REM-Ca—Al—O—S-based inclusions and forms a composite.

For example, as shown in FIG. 1, a composite inclusion, which has a main structure of REM-Al—O—S—(TiN) or REM-Ca—Al—O—S—(TiN), has a height of surface unevenness of 0.5 μm or less and an approximately spherical shape. Accordingly, this composite inclusion is a harmless inclusion that does not become a starting point of fracture. In addition, the reason why TiN precipitates to the surface of REM-Al—O—S or REM-Ca—Al—O—S is assumed to be as follows. A crystal lattice structure of TiN is similar to a crystal lattice structure of REM-Al—O—S or REM-Ca—Al—O—S, that is. TiN and REM-Al—O—S or REM-Ca—Al—O—S have a crystal structure matching property. Hereinafter, REM-Al—O—S—(TiN) or REM-Ca—Al—O—S—(TiN) may be referred to as a composite inclusion, and the REM-Al—O—S-based inclusion or the REM-Ca—Al—O—S-based inclusion may be referred to as an oxysulfide-based inclusion in some cases.

In addition, Ti is not contained in the REM-Al—O—S-based inclusions or in the REM-Ca—Al—O—S-based inclusions of the steel for induction hardening according to this embodiment as an oxide. This is considered to be because the amount of C in the steel for induction hardening according to this embodiment is 0.45% to 0.85% and high, the oxygen level during deoxidation is low, and the amount of a Ti oxide generated is very small. In addition, Ti is not contained in the REM-Al—O—S-based inclusions or the REM-Ca—Al—O—S-based inclusions as an oxide, and thus the crystal lattice structure of the REM-Al—O—S-based inclusions or the REM-Ca—Al—O—S-based inclusions and the crystal lattice structure of TiN become similar to each other.

In addition, REM has a function of preventing stretching or coarsening of an oxide such as an Al—O-based inclusion or an Al—Ca—O-based inclusion by reforming the Al—O-based inclusion or the Al—Ca—O-based inclusion into the REM-Al—O—S-based inclusion or the REM-Ca—Al—O—S-based inclusion which have a high melting point. In addition, in a case where Ca is included, Ca is included in the steel that REM is contained, and thus CaS which is Ca-based sulfide, a Ca—Mn—S-based inclusion and the like do not exist.

To attain the effect, the steel must contain a constant amount or more of REM based on the total oxygen amount (T.O amount). In a case where the molten steel does not contain a predetermined amount or more of REM, Al—O or Al—Ca—C), which are not reformed into REM-Al—O—S-based inclusions or REM-Ca—Al—O—S-based inclusions, remain. Therefore, this case is not preferable. In addition, it is necessary for the molten steel to contain a constant amount or more of REM based on the amount of S. In a case where the molten steel does not contain a constant amount or more of REM, it is difficult to fix S by forming REM-Al—O—S-based inclusions or REM-Ca—Al—O—S-based inclusions, and thus coarse MnS is generated. Therefore, this case is not preferable.

In addition, it is necessary for the steel to contain a constant amount or more of the REM-Al—O—S-based inclusion or the REM-Ca—Al—O—S-based inclusion. In a case where the number of the REM-Al—O—S-based inclusions or the REM-Ca—Al—O—S-based inclusions is small, generation of a REM-Al—O—S—(TiN)-based composite inclusion or a REM-Ca—Al—O—S—(TiN)-based composite inclusion becomes insufficient, and thus this case is not preferable.

The present inventors have made an examination from the above-described viewpoint, and they have experimentally found that when the steel contains less than 0.0001% of REM, an effect by REM that is contained in steel is insufficient. Accordingly, the lower limit of the amount of REM is set to 0.0001%, preferably 0.0003% or more, more preferably 0.0010% or more, and still more preferably 0.0020% or more. However, when the amount of REM exceeds 0.050%, the cost increases, and clogging of a cast nozzle tends to occur. Therefore, the manufacture of steel is hindered. Accordingly, the upper limit of the amount of REM is set to 0.050%, is preferably set to 0.035%, and is more preferably set to 0.020%.

O: 0.0001% to 0.0030%

O is an element which is removed from steel by &oxidation, but O is necessary to generate a composite inclusion having a main structure of REM-Al—O—S—(TiN) or REM-Ca—Al—O—S—(TiN). To obtain an effect by O that is contained in steel, it is necessary for the steel to contain 0.0001% or more of O. However, when the amount of O exceeds 0.0030%, a large amount of an oxide such as $Al_2O_3$ remains, and thus the fatigue life decreases. Accordingly, the upper limit of the amount of O is set to 0.0030%. In addition, the amount of O is preferably 0.0003% to 0.0025%.

Ca: 0.0050% or Less

Ca may be contained in steel as necessary. The steel contains Ca that is coupled to REM and O to form a composite inclusion having a main structure of REM-Ca—Al—O—S—(TiN). Therefore, it is preferable that the steel contain 0.0005% or more of Ca and more preferably contain 0.0010% or more of Ca. However, when the amount of Ca exceeds 0.0050%, a large amount of coarse CaO is generated, and thus the fatigue life decreases. Accordingly, the upper limit thereof is set to 0.0050%. In addition, the amount of Ca is preferably 0.0045% or less.

The above-described components are included as a basic chemical composition of the steel for induction hardening according to this embodiment, and the balance consists of Fe and impurities. In addition, "impurities" in the "the balance consists of Fe and impurities" represents ore or scrap as a raw material when steel is industrially manufactured, or a material that is unavoidably mixed in due to the manufacturing environment and the like. However, in the steel for induction hardening according to this embodiment, it is necessary to limit Ti, N, P, and S, which are impurities, as follows.

Ti: Less Than 0.005%

Ti is an impurity. When Ti exists in steel, inclusions such as TiC, TiN, and TiS are generated. The inclusions deteriorate the fatigue properties. Accordingly, the amount of Ti is less than 0.005%, and is preferably 0.0045% or less.

Figure 2:
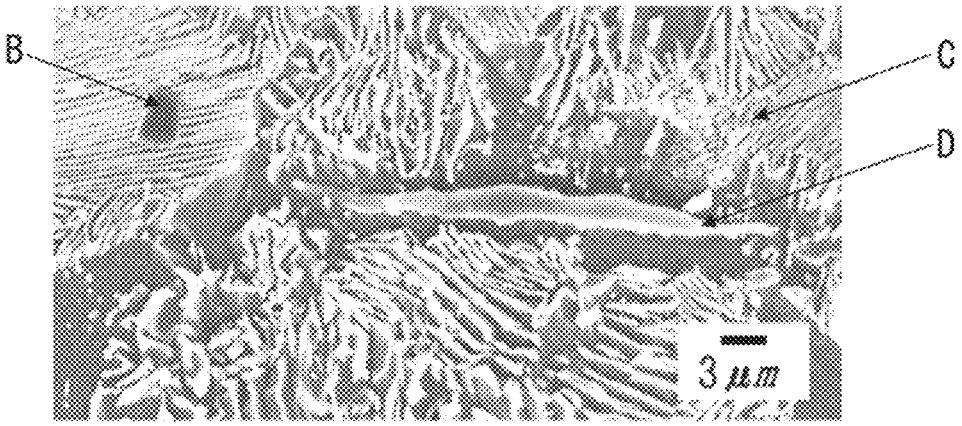
FIG. 2 is a view showing a generation aspect of coarse MnS and TiN having an angular shape.

Particularly, for example. TiN is generated in an angular shape as shown in FIG. 2. The TiN having an angular shape becomes a starting point of fracture. Accordingly, TiN is formed a composite with REM-Al—O—S or REM-Ca—Al—O—S. The lower limit of the amount of Ti includes 0%, but it is industrially difficult to realize 0%.

In addition, in the steel for induction hardening according to this embodiment, even though the steel contains more than 0.001% of Ti that is upper limit of an amount of Ti in the related art, when a steel for induction hardening contains less than 0.005% of Ti as a impurity. TiN forms a composite inclusion with REM-Al—O—S or REM-Ca—Al—O—S, and this the fatigue properties do not deteriorate. Accordingly, it is possible to stably manufacture steel for induction hardening with excellent fatigue properties.

N: 0.015% or Less

N is an impurity. When N exists in steel, N forms a nitride and deteriorates the fatigue properties. In addition, ductility and toughness are deteriorated due to strain aging. When an amount of N exceeds 0.015%, a harmful result, such as deterioration in the fatigue properties, the ductility, and the toughness, becomes significant. Accordingly, the upper limit of the amount of N is 0.015%. The amount of N is preferably 0.005% or less. The lower limit of the amount of N includes 0%, but it is industrially difficult to realize 0%.

P: 0.03% or Less

P is an impurity. When P exists in steel. P segregates at a grain boundary and decreases the fatigue life. When the amount of P exceeds 0.03%, a decrease in the fatigue life becomes significant. Accordingly, the upper limit of the amount of P is 0.03%. The amount of P is preferably 0.02% or less. The lower limit of the amount of P includes 0%, but it is industrially difficult to realize 0%.

S: 0.01% or Less

S is an impurity. When S exists in steel. S forms a sulfide. When the amount of S exceeds 0.01%, for example, as shown in FIG. 2, S is coupled to Mn to form coarse MnS, and decreases the fatigue life. Accordingly, the upper limit of the amount of S is 0.01%. The amount of S is preferably 0.0085% or less. It is industrially difficult to set the lower limit of the amount of S to 0%.

In addition to the above-described elements, the following elements may be selectively contained. Hereinafter a selective element will be described.

The steel for induction hardening according to this embodiment may contain at least one of 2.0% or less of Cr, 0.70% or less of V 1.00% or less of Mo, 1.00% or less of W, 3.50% or less of Ni, 0.50% or less of Cu, less than 0.050% of Nb, and 0.0050% or less of B.

Cr: 2.0% or Less

Cr is an element that increases the hardenabilitv and improves the fatigue life. To attain this effect, it is preferable for the steel to contain 0.05% or more of Cr. However, when the amount of Cr exceeds 2.0%, the effect that the hardenability is improved is saturated and hardness of the base metal is increased, and thus the tool service life during cutting decreases. In addition, Cr becomes a cause of a quenching crack. Accordingly the upper limit of the amount of Cr is set to 2.0%, and the amount of Cr is preferably set to 0.5% to 1.6%.

V: 0.70% or Less

V is an element that is coupled to C and N in steel to form a carbide, a nitride, or a carbonitride, and contributes to precipitation strengthening of steel. To stably attain this effect, it is preferable that the steel contain 0.05% or more of V, and more preferably 0.1% or more of V However, when the amount of V exceeds 0.70%, the effect by containing V becomes saturated. Accordingly, the upper limit of the amount of V is set to 0.70%. The amount of V is preferably set to 0.50% or less.

Mo: 1.00% or Less

Mo is an element that is coupled to C in steel to form a carbide and contributes to an improvement in strength of steel due to precipitation strengthening. To stably attain this effect, it is preferable that the steel contain 0.05% or more of Mo, and more preferably 0.1% or more of Mo. However, when the amount of Mo exceeds. 1.00%, the machinability of the steel decreases. Accordingly, the upper limit of the amount of Mo is set to 1.00%. The amount of Mo is preferably 0.75% or less.

W: 1.00% or Less

W is an element that forms a hard phase and contributes to an improvement in the fatigue properties. To stably attain this effect, it is preferable that steel contain 0.05% or more of W and more preferably contains 0.1% or more of W. However, when the amount of W exceeds 1.00%, the machinability of the steel decreases. Accordingly, the upper limit of the amount of W is set to 1.00%. The amount of W is preferably 0.75% or less.

Ni: 3.50% or Less

Ni is an element that increases corrosion resistance and contributes to an improvement in the fatigue life. To stably attain this effect, it is preferable that the steel contain 0.10% or more of Ni, and more preferably 0.50% or more of Ni. However, when the amount of Ni exceeds 3.50%, machinability of steel decreases. Accordingly, the upper limit of the amount of Ni is set to 3.50%. The amount of Ni is preferably 3.00% or less.

Cu: 0.50% or Less

Cu is an element that contributes to an improvement in the fatigue properties due to a strengthening of the base metal. To stably attain this effect, it is preferable that the steel contain 0.10% or more of Cu, and more preferably 0.20% or more of Cu. However, when the amount of Cu exceeds 0.50%, cracks are generated during hot working. Accordingly, the upper limit of the amount of Cu is set to 0.50%. The amount of Cu is preferably 0.35% or less.

Nb: Less than 0.050%

Nb is an element that contributes to an improvement in the fatigue properties due to a strengthening of the base metal. To stably attain this effect, it is preferable that the steel contain 0.005% or more of Nb and more preferably 0.010% or more of Nb. However, when the amount of Nb is 0.050% or more, the effect by containing Nb becomes saturated. Accordingly, the amount of Nb is set to less than 0.050%. The amount of Nb is preferably 0.030% or less.

B: 0.0050% or Less

B is an element that contributes to an improvement in the fatigue properties and strength due to gain boundary strengthening. To stably attain this effect, it is preferable that the steel contain 0.0005% or more of B. and more preferably 0.0010% or more of B. However, when the amount of B exceeds 0.0050%, the effect by containing B becomes saturated. Accordingly, the upper limit of the amount of B is set to 0.0050%. The amount of B is preferably 0.0035% or less.

In the steel for induction hardening according to this embodiment. S is fixed as the REM-Al—O—S-based inclusion or the REM-Ca—Al—O—S-based inclusion. Accordingly, generation of MnS, which is stretched to 10 μm or more and hinders the fatigue properties, is suppressed. Typically, in a case where MnS exists in steel, as shown FIG. 2, MnS is stretched by rolling. However, in the steel for induction hardening according to this embodiment. REM fixes S to generate the REM-Al—O—S-based inclusion or the REM-Ca—Al—O—S-based inclusion. These oxysulfides are hard, and thus even when being subjected to rolling, the size thereof does not vary. In addition, S is consumed as the REM-Al—O—S-based inclusion or the REM-Ca—Al—O—S-based inclusion, and thus MnS is not generated or the amount thereof generated is reduced. In addition, in the steel for induction hardening according to this embodiment, as shown in FIG. 1, TiN adheres to the REM-Al—O—S-based inclusion or the REM-Ca—Al—O—S-based inclusion, and thus an approximately spherical composite inclusion having a main structure of REM-Al—O—S—(TiN) or REM-Ca—Al—O—S—(TiN) is formed.

Here, for example, as shown in FIG. 1, the "approximately spherical shape" represents a shape in which a maximum height of surface unevenness is 0.5 μm or less, and a value obtained by dividing the major axis of the inclusion by the minor axis of the inclusion, that is, an aspect ratio is 3 or less.

For example, as shown in FIG. 2, hard TiN, which does not adhere to REM-Al—O—S or REM-Ca—Al—O—S and independently exists in steel, has a maximum diameter of 1 μm or more and has an angular shape. Therefore, TiN, which does not adhere to REM-Al—O—S or REM-Ca—Al—O—S and independently exists in steel, becomes a starting, point of fracture, and thus TiN has an adverse effect on the fatigue life. However, in the steel for induction hardening according to this embodiment. TiN adheres to REM-Al—O—S or REM-Ca—Al—O—S, and constitutes the approximately spherical composite inclusion having a main structure of REM-Al—O—S—(TiN) or REM-Ca—Al—O—S—(TiN), and thus the above-described adverse effect due to the shape of TiN that does not form the composite inclusion is not generated.

In addition, in the steel for induction hardening according to this embodiment, to improve the fatigue life, it is necessary to suppress the amount of "MnS having a maximum diameter of 10 μm or more" and "TiN having a maximum diameter of 1 μm or more" generated, which have an adverse effect on the fatigue life, to a total of 5 pieces/mm$^2$ or less on the basis of a number density. In addition, it is preferable that the amount of "MnS having a maximum diameter of 10 μm or more" and "TiN having a maximum diameter of 1 μm or more" generated be as small as possible. The amount thereof generated is preferably 4 pieces/mm$^2$ or less, and is more preferably 3 pieces/mm$^2$ or less.

A preferred method of manufacturing the steel for induction hardening according to this embodiment will be described.

In the method of manufacturing the steel for induction hardening according to this embodiment, a sequence of adding a deoxidizing agent is important during refining of molten steel. In this manufacturing method, first deoxidation is performed by using Al. Then, deoxidation is performed for 5 minutes or longer by using REM and then ladle refining including vacuum degassing is performed. Alternatively, after deoxidation using REM. Ca is added as necessary, and then the ladle refining including the vacuum degassing is performed.

Prior to deoxidation with REM, when deoxidation is performed by using an element other than Al, it is difficult to stably reduce an amount of oxygen. Therefore, in this manufacturing method, the deoxidizing agent is added in the order of Al and REM, or in the order of Al, REM and Ca. As a result, the REM-Al—O-based inclusion that is an oxide-based inclusion or the REM-Ca—Al—O-based inclusion that is an oxide-based inclusion is generated. Accordingly, generation of the Al—O-based inclusions or the Al—Ca—O-based inclusions, which are harmful, is prevented. In addition, for the REM added, a misch metal (alloy composed of a plurality of rare-earth metals) and the like may be used, and for example, an aggregated misch metal my be added to molten steel at the end of the refining. At this time, a flux such as CaO—$CaF_2$ is added to approximately perform desulfurization and refining of an inclusion by Ca.

Deoxidation with REM is performed for 5 minutes or longer. When a deoxidation time is shorter than 5 minutes, reforming of the Al—O-based inclusions or the Al—Ca—O-based inclusions, which are generated once, does not progress, and as a result, it is difficult to reduce amount of the Al—O-based inclusions or the amount of the Al—Ca—O-based inclusions. In addition, when deoxidation is performed by using an element other than Al firstly, it is difficult to reduce the amount of oxygen. In addition, even in a case Where Ca is added to molten steel by adding a flux thereto, it is necessary to perform deoxidation with REM for 5 minutes or longer.

In a case where Ca is added as necessary for deoxidation, when Ca is added prior to REM, the number of Al—Ca—O-based inclusions which tend to be stretched at a low melting point are generated. As a result, even when REM is added after many numbers of Al—Ca—O-based inclusions are generated, it is difficult to reform a composition of the inclusions. Accordingly, in a case where Ca is added, it is necessary to add Ca after REM is added.

As described above, in this manufacturing method, since S is fixed by the REM-Al—O—S-based inclusion that is an oxysulfide-based inclusion or the REM-Ca—Al—O—S-based inclusion that is an oxysulfide-based inclusion, generation of coarse MnS is suppressed. In addition, since the REM-Al—O—S-based inclusion that is an oxysulfide or the REM-Ca—Al—O—S-based inclusion that is an oxysulfide form a composite with TiN, the number of TiN, which does not adhere to the REM-Al—O—S-based inclusion that is an oxysulfide or the REM-Ca—Al—O—S-based inclusion that is an oxysulfide and independently precipitate, decreases. Accordingly, the fatigue properties of the steel for induction hardening are improved.

However, particularly, in a case where the steel for induction hardening according to this embodiment is used in a bearing, it is ideal that the amount of MnS generated and the amount of TiN that independently exists generated are small, but it is not necessary that no MnS or TiN exist at all. In addition, MnS independently crystallizes in many cases using an oxide as a nucleus. Accordingly, an oxide may be found at the inside such as the central portion of MnS in many cases. The MnS is distinguished from the REM-Al—O—S-based inclusion that is an oxysulfide or the REM-Ca—Al—O—S-based inclusion that is an oxysulfide.

To reliably improve the fatigue properties demanded for the steel for induction hardening, it is necessary for the REM-Al—O—S-based inclusion that is an oxysulfide-based inclusion or the REM-Ca—Al—O—S-based inclusion that is an oxysulfide-based inclusion, and the amount of MnS and TiN that independently exist generated satisfy the following conditions. Specifically, it is necessary for the sum of the number density of MnS having a maximum diameter of 10 μm or more and the number density of TiN having a maximum diameter of 1 μm or more to be set to a total of 5 pieces or less per observation surface of 1 $mm^2$.

As described above. MnS is stretched by rolling. When a repetitive stress is applied to the stretched MnS, the stretched MnS becomes a starting point of fracture, and has an adverse effect on the fatigue life. Accordingly, all MnS, which are stretched so as to have a long diameter, that is, a maximum diameter of 10 μm or more, have an adverse effect on the fatigue life, and thus the maximum diameter of MnS does not have the upper limit thereof. In addition, although TiN is not stretched by rolling as such as MnS, the angular shape thereof becomes a starting point of fracture. Coarse TiN has an adverse effect on the fatigue life similar to MnS. All TiN having a maximum diameter of 1 μm or more have an adverse effect on fatigue life.

When the sum of the number of MnS and the number of TiN exceeds a total of 5 pieces per observation surface of 1 $mm^2$, that is, when a number density exceeds 5 pieces/$mm^2$, the fatigue properties of the steel for induction hardening deteriorate. Particularly, in a case where the steel for induction hardening according to this embodiment is used in a bearing, MnS and TiN greatly deteriorate the fatigue properties. Accordingly, it is preferable that the sum of the number of MnS and the number of TiN per observation surface of 1 $mm^2$ be 5 pieces or less. More preferably, the sum of the number of MnS and the number of TiN per observation surface of $mm^2$ is set to 4 pieces or less, that is, the number density is set to 4 pieces/$mm^2$ or less. Still more preferably, the sum of the number of MnS and the number of TiN per observation surface of 1 $mm^2$ is set to 3 pieces or less, that is, the number density is set to 3 pieces/$mm^2$ or less. In addition, the lower limit of the sum of the number of MnS and the number of TiN is more than 0.001 pieces per observation surface of 1 $mm^2$.

In addition, to reliably improve the fatigue properties, it is preferable that the number fraction of a composition inclusion to which TiN adheres with respect to the total inclusions be 50% or more. The angular shape of TiN, which independently exists without adhesion to an inclusion, becomes a starting point of fracture. In addition, in a manner similar to MnS, TiN which is coarsened without adhesion to an inclusion has an adverse effect on fatigue life. Particularly, when the number fraction of a composite inclusion, to which TiN adheres, with respect to the total inclusions is less than 50%, coarse TiN greatly deteriorate the fatigue properties. Accordingly, the number fraction of the composite inclusions, to which TiN adheres, with respect to the number of total inclusions is preferably 50% or more.

As described above, the amount of the Al—O-based inclusion and the Al—Ca—O-based inclusion of an oxide such as $Al_2O_3$, which is a harmful element having an adverse effect on the fatigue properties of the steel for induction hardening, is reduced because the Al—O-based inclusions and the Al—Ca—O-based inclusions are mainly reformed into REM-Al—O-based inclusions or the REM-Ca—Al—

O-based inclusions, which are oxide-based inclusion, due to an addition effect of REM. In addition, MnS that form harmful inclusions is reformed into REM-Al—O—S-based inclusions or REM-Ca—Al—O—S-based inclusions, which are oxysulfide-based inclusions, and thus the amount of MnS generated is limited. Particularly, the amount of MnS generated is suppressed due to Ca.

In addition, TiN that is a harmful inclusion preferentially crystallizes or precipitates to a surface of the REM-Al—O—S-based inclusion that is an oxysulfide-based inclusion or the REM-Ca—Al—O—S-based inclusion that is an oxysulfide-based inclusion. As described above, generation of MnS or TiN, which are harmful, is suppressed due to the addition of REM or Ca, and thus it is possible to obtain steel for induction hardening with excellent fatigue properties.

The specific gravity of the REM-Al—O—S-based inclusions or the REM-Ca—Al—O—S-based inclusions, which are oxysulfide-based inclusions, is 6 and is close to a specific gravity of 7 of steel, and thus floating and separation are less likely to occur. In addition, when pouring molten steel into a mold, the oxysulfides penetrate up to a deep position of unsolidified layer of a cast piece due to a downward flow, and thus the oxysulfides tend to segregate at the central portion of the cast piece. When the oxysulfides segregate at the central portion of the cast piece, the oxysulfides are deficient in a surface layer portion of the cast piece. Therefore, it is difficult to generate a composite inclusion by adhering TiN to the surface of the oxysulfides. Accordingly, a detoxifying effect of TiN is weakened at a surface layer portion of a product.

Accordingly, in this manufacturing method, to prevent segregation of the REM-Al—O—S-based inclusions or the REM-Ca—Al—O—S-based inclusions, which are oxysulfides, molten steel is circulated in the mold in a horizontal direction to realize uniform dispersion of the inclusions. The circulation of the molten steel inside the mold is preferably performed at a flow rate of 0.1 m/minute or faster so as to realize further uniform dispersion of the oxysulfide-based inclusions. When the circulation speed inside the mold is slower than 0.1 m/minute, the oxysulfide-based inclusions are less likely to be uniformly dispersed. Accordingly, the molten steel may be stirred to realize uniform dispersion of the oxysulfide-based inclusions. As stirring means, for example, an electromagnetic force and the like may be applied.

Next, the cast piece after casting is held at a temperature region of 1200° C. to 1250° C. for 60 seconds to 60 minutes to obtain the above-described composite inclusion. This temperature region is a temperature region at which a composite precipitation effect of TiN with respect to the REM-Al—O—S-based inclusions or the REM-Ca—Al—O—S-based inclusions, which are oxysulfide-based inclusion, is large. Holding at this temperature region for 60 seconds or more is a preferable condition at Which TiN is allowed to sufficiently grow at the surface of the REM-Al—O—S-based inclusion or the REM-Ca—Al—O—S-based inclusion which are oxysulfides. However, even when the steel is held at this temperature region for 60 minutes or more, it is difficult to grow up to a size of TiN more than the required size of TiN and thus a holding time is preferably 60 minutes or less. As described above, in order to form a composite with the REM-Al—O—S-based inclusions or the REM-Ca—Al—O—S-based inclusions and to suppress generation of TiN that is independently generated without adhesion to these inclusions, it is preferable to hold the cast piece after casting at a temperature region of 1200° C. to 1250° C. for 60 seconds to 60 minutes.

In addition, typically, the cast piece after casting contains TiN that have crystallized already, and Ti and N that form a solid solution and promote growth of TiN during a cooling process to room temperature. When the cast piece is held at a temperature region of 1200° C. to 1250° C. Ti and N which form a solid solution are dispersed to a position, at which TiN crystallizes and grows already as a nucleus, and grows as TiN at the position. In the invention, TiN crystallizes or precipitates using the REM-Al—O—S-based inclusions or the REM-Ca—Al—O—S-based inclusions as a nucleus. Accordingly, when holding is performed at a temperature region of 1200° C. to 1250° C., it is considered that Ti and N which form a solid solution in steel can be dispersed and grow as TiN. In this manner, dispersion of TiN is promoted, and thus it is possible to suppress generation of coarse TiN that independently exists.

In this manufacturing method, the cast piece after casting is heated to a heating temperature and is held at a temperature region of 1200° C. to 1250° C. for 60 seconds to 60 minutes, and then hot-rolling or hot-forging is performed to manufacture the steel for induction hardening. In addition, cutting into a shape close to a final Shape is performed, and induction hardening is performed to make the Vickers hardness of the surface be 600 Hv or more.

A rolling member or a sliding member, which use the steel for induction hardening of the invention, is excellent in the fatigue properties. In addition, the rolling member or the sliding member is typically finished to a final product by using means capable of performing high-hardness and high-accuracy processing such as grinding as necessary.

EXAMPLES

Next, examples of the invention will be described, but conditions in the examples are conditional examples that are employed to confirm applicability and an effect of the invention and the invention is not limited to the conditional examples. The invention can employ various conditions as long as the object of the invention is achieved without departing from the gist of the invention.

During the vacuum degassing in the ladle refining, refining was performed under conditions shown in Table 1 by using metal Al, a misch metal, and a flux of $CaO:CaF_2$=50:50 (mass ratio), and a Ca—Si alloy as necessary to obtain molten steel having a chemical composition shown in Table 2A and Table 2B, or Table 4A and Table 4B. The molten steel was casted to a 300 mm square cast piece by using a continuous casting apparatus. At that time, circulation inside a mold was performed by electromagnetic agitation under conditions shown in Table 1, thereby casting a cast piece.

The cast piece, which was ladle-refined and casted under the conditions shown in Table 1, was heated and held under conditions shown in Table 1, was hot-forged into a cylindrical rod with φ of 50 mm, and was finally subjected to grinding into φ of 10 mm. A plurality of cylindrical rods with φ of 10 mm, which were composed of a raw material for test specimens, was prepared from the same kind of steel. One of the cylindrical rods was provided for chemical composition analysis and inclusion analysis.

Figure 3:
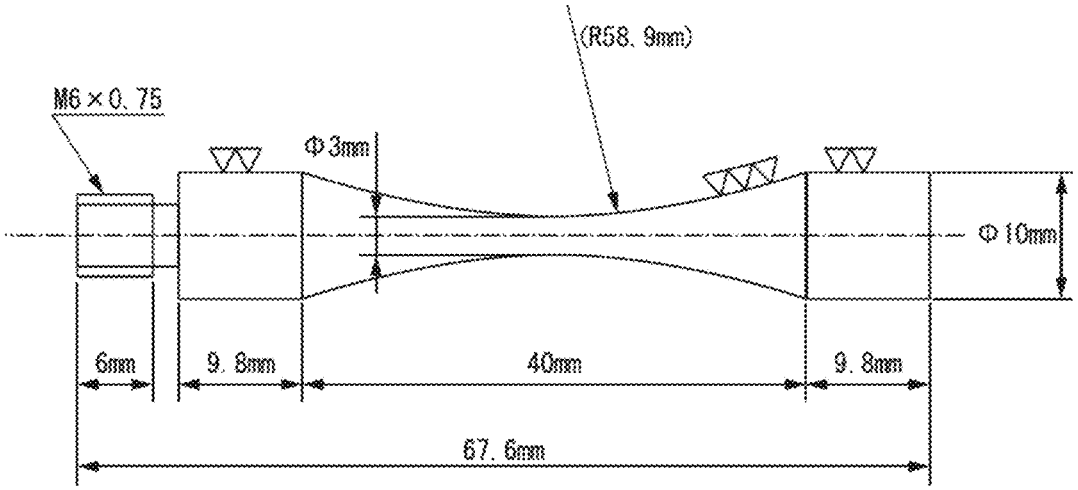
FIG. 3 is a view showing the shape of a fatigue specimen.

In addition, with regard to the remaining final cylindrical rods with φ of 10 mm among the plurality of cylindrical rods that were manufactured, for supply to a fatigue test for confirmation of suitability for the rolling member or the sliding member which are used after performing induction hardening, and tempering, a raw material, which is larger than a shape of the fatigue specimen by approximately 0.3 mm, was cut from the cylindrical rods with φ of 10 mm, and induction hardening was performed in order for a load application portion to uniformly have the same hardness of 600 Hv or more as that of a coating material for bearings. Then, tempering was performed at 180° C. and was finished by grinding and polishing to become a fatigue specimen having a shape shown in FIG. 3. With regard to partial fatigue specimens, samples for measurement of Vickers hardness were collected from the load application portion.

With regard to the above-described sample for chemical composition analysis and inclusion analysis, a cross-section in a stretching direction thereof was mirror-polished, and was processed with selective potentiostatic etching by an electrolytic dissolution method (SPEED method). Then, measurement with a scanning electron microscope was performed with respect to inclusions in steel in a range of 2 mm width in a radial direction which centers around a depth of the half of a radius from a surface, that is, a depth of 2.5 mm from the surface, and a length of 5 mm in a rolling direction, a composition of the inclusion was analyzed using EDX, and inclusions in 10 $mm^2$ of the sample were counted to measure a number density. In addition, the fatigue life was measured with respect to the fatigue specimen by applying a repetitive stress by using an ultrasonic fatigue test, and the number of cycles at which 10% of the evaluation sample was fractured was evaluated as fatigue properties $L_{10}$ by using Weibull statistics. The fatigue test was performed by using an ultrasonic fatigue tester (USF-2000, manufactured by Shimadzu Corporation). As test conditions, a test frequency was set to 20 kHz, a stress ratio (R) was set to −1, and an actual load amplitude was set to 1000 MPa. In addition, a 180° C. tempering Vickers hardness test was performed in accordance with JIS Z 2244.

Table 1 shows manufacturing conditions including steel refining conditions, casting conditions, heating and holding conditions after casting in the examples. Manufacturing conditions A, E, F, J, K, L, M, N, and O pertain to manufacturing conditions according to the present examples. Manufacturing conditions B, C, D, I, P, and Q are manufacturing conditions in a case where the manufacturing conditions are not preferable and do not pertain to the present examples.

Among the heating and holding conditions shown in Table 1, in the manufacturing condition B, a holding time was lower than a preferable range. In the manufacturing condition C, a holding temperature was lower than a preferable range. In the manufacturing condition D, the holding temperature was higher than the preferable range. In addition, with regard to the manufacturing condition I, a deoxidizing time after adding REM among ladle refining conditions was lower than the preferable range. In addition, with regard to the manufacturing condition P and the manufacturing condition Q, a sequence of adding REM was not preferable in a deoxidizing process. The above-described manufacturing conditions B, C, D, I, P, and Q are employed in steel numbers 52, 62, 63, 56, 57, and 58, respectively, in Table 4A, Table 4B, Table 5A, and Table 5B. In any steel number, a chemical composition is included in a range of the invention as described in Table 4A and Table 4B. However, as described in Table 5A and Table 5B, the number fraction of a composite inclusion, to which TiN is adhered, with respect to total inclusions was less than 50%, the number density of MnS having a maximum diameter of 10 μm and TiN having a maximum diameter of 1 μm or more which independently existed was excessive and exceeded the range of the invention, and thus the fatigue properties $L_{10}$ in a case of performing induction hardening were inferior to those of the present examples.

With regard to a steel number 55 in which REM was excessively included, as shown in Table 5A and Table 5B, the manufacturing condition A was intended to be employed, but a casting nozzle was clogged, and thus casting was impossible. Therefore, the residue of steel that remained in a casting nozzle or a tundish was collected and a chemical composition was analyzed. The results are shown in Table 4A and Table 4B as a composition of comparative steel. As a result, with regard to the steel number 55, it was proved that the amount of REM was more excessive than the range of the invention.

As shown in Table 4A, steel number 54 contained less REM than is contained in a steel of the invention, and thus as shown in Table 5A, an effect by adding REM substantially disappeared, and an Al—Ca—O-based precipitation increased. In the steel numbers 52, 54, 56, 57, 58, 62, and 63, the number fraction of a composite inclusion, to which TiN adhered, with respect to the total inclusions was less than 50%, and the number density of MnS having a maximum diameter of 10 μm and TiN having a maximum diameter of 1 μm or more which independently existed was excessive and exceeded the range of the invention, and thus the fatigue properties $L_{10}$ were inferior to those of the present examples.

In steel numbers 60 and 61 shown in Table 4A, the amount of Ca was excessive, and precipitation of Al—Ca—O and the like increased in the respective steel numbers as shown in Table 5A and Table 5B, and thus the balance of inclusion generation collapsed. Therefore, the number fraction of a composite inclusion, to which TiN adhered, with respect to the total inclusions was less than 50%, and a number density of MnS having a maximum diameter of 10 μm and TiN having a maximum diameter of 1 μm or more which independently existed was excessive and exceeded the range of the invention, and thus the fatigue properties $L_{10}$ were inferior to those of the present examples.

In steel numbers 53 and 59, as shown in Table 4A, Ti or S was more than the range of the invention, and thus a number of TiN, MnS, and the like were generated. As a result, the balance of inclusion generation collapsed. Therefore, the sum of the number density of TiN having a maximum diameter of 1 μm or more which independently existed without adhesion to an inclusion, and the number density of MnS having a maximum diameter of 10 μm or more was 5 pieces/$mm^2$ or more. In addition, as shown in Table 5A and Table 5B, the number fraction of composite inclusions, to which TiN adhered, with respect to the total inclusions was less than 50%, and thus the fatigue properties $L_{10}$ were inferior to those of the present examples. In addition, in a steel number 70 which contained more P than is contained in a steel of the invention, as shown in Table 5A and Table 5B, the number fraction of composite inclusions, to which TiN adhered, with respect to total inclusions was 50% or more. However, P segregated at a grain boundary, and thus the fatigue properties $L_{10}$ were lower than those of the present examples.

As shown in Table 4A, steel number 65 contained more C, which essentially plays a role in precipitation strengthening, than is contained in a steel of the invention. In addition, as shown in Table 4A, steel number 67 contained more Si, which is necessary for securing hardenability, than is contained in a steel of the invention. In addition, shown in Table 4A, steel number 69 contained more Mn, which is necessary for securing hardenability, than is contained in a steel of the invention. Accordingly, in the steel numbers 65, 67, and 69, as shown in Table 5A, a quenching crack was generated during induction hardening, and thus evaluation other than a chemical composition analysis was stopped.

As shown in Table 4A, steel number 64 contains more C than is contained in a steel of the invention. In addition, as shown in Table 4A, steel number 66 contains less Si than is contained in a steel of the invention. In addition, steel number 68 contained less Mn than is contained in a steel of the invention. In these steel numbers, as shown in Table 5A and Table 5B, the number fraction of a composite inclusion, to which TiN adhered, with respect to the total inclusion was secured. However, the fatigue properties $L_{10}$ and the 180° C. tempering Vickers hardness were inferior to those of the present examples.

Cr is an element that increases hardenability. However as shown in Table 4B, steel number 71 contained more Cr than is contained in a steel of the invention, and thus as shown in Table 5A, a quenching crack was generated. Therefore, evaluation with respect to the steel number 71 was stopped.

As shown in Table 4A, steel number 72 contains less Al than is contained in a steel of the invention. On the other hand, as shown in Table 4A, steel number 73 contained more Al than is contained in a steel of the invention. As shown in Table 4A, steel number 74 contained more N than is contained in a steel of the invention. As shown in Table 4A, steel number 75 contained less O than contained in a steel of the invention. On the other hand, as shown in Table 4A, steel number 76 contains more O than is contained in a steel of the invention. Accordingly, in these steel numbers, as shown in Table 5A and Table 5B, the number fractions of composite inclusions, to which TiN adhered, with respect to the total inclusion was less than 50%, and the number densities of MnS having a maximum diameter of 10 μm and TiN having a maximum diameter of 1 μm or more which independently existed were excessive and were greater than in a steel of the invention, and thus the fatigue properties $L_{10}$ were inferior to those of the present examples.

As shown in Table 4B, with regard to a steel number 78 which contained a greater amount of Mo than is contained in a steel of the invention, a steel number 79 which contained a greater amount of W than is contained in a steel of the invention, a steel number 81 which contains a greater amount of Cu than is contained in a steel of the invention, a steel number 82 which contained a greater amount of Nb than is contained in a steel of the invention, and a steel number 83 which contains a greater amount of B than is contained in a steel of the invention, a crack occurred during processing into a cylindrical rod shape, and thus evaluation other than chemical composition analysis was stopped.

The present examples are shown as steel numbers 5 to 48 and 51 in Table 2A, Table 2B, Table 3A, and Table 3B, From Table 3A and Table 3B, it could he seen that in the present examples, the sum of a number density of TiN having a maximum diameter of 1 μm or more which independently existed without adhesion to an inclusion, and a number density of MnS having a maximum diameter of 10 μm or more was 5 pieces/$mm^2$ or less in all of the steel numbers. In addition, it could be seen that the number fraction of a composite inclusion, to which TiN adhered, with respect to all inclusions was secured to a value of 50% or more. In addition, in the present examples subjected to induction hardening, and 180° C. tempering, the fatigue properties $L_{10}$ evaluated by a repetitive stress were $10^7$ cycles or more, and were superior to those of steel numbers of comparative examples out of range of the invention. In addition, it can be seen that in the present examples, the 180° C. tempering Vickers hardness is 600 Hv or more, and is suitable for a rolling member or a sliding member.

TABLE 1

| | LADLE REFINING CONDITIONS | | CASTING CONDITIONS | HEATING AND HOLDING CONDITIONS | | |
|---|---|---|---|---|---|---|
| MANUFACTURING CONDITION CODE | SEQUENCE OF Al DEOXIDATION PROCESS, REM DEOXIDATION PROCESS, Flux PROCESS, OR VACUUM DEGASSING PROCESS | REM DEOXIDATION TIME (minute) | CIRCULATION FLOW RATE OF MOLTEN STEEL INSIDE MOLD (m/minute) | HEATING TEMPERATURE (° C.) | HOLDING TEMPERATURE (° C.) | HOLDING TIME (second) |
| A | Al→REM→Ca→DEGASSING | 6 | 0.2 | 1280 | 1220 | 120 |
| B | Al→REM→Ca→DEGASSING | 6 | 0.2 | 1250 | 1200 | 45 |
| C | Al→REM→Ca→DEGASSING | 6 | 0.2 | 1280 | 1190 | 120 |
| D | Al→REM→Ca→DEGASSING | 6 | 0.2 | 1280 | 1260 | 120 |
| E | Al→REM→Ca→DEGASSING | 6 | 0.3 | 1280 | 1220 | 150 |
| F | Al→REM→Ca→DEGASSING | 8 | 0.2 | 1280 | 1220 | 120 |
| I | Al→REM→DEGASSING | 3 | 0.2 | 1280 | 1220 | 80 |
| J | Al→REM→DEGASSING | 6 | 0.2 | 1280 | 1220 | 150 |
| K | Al→REM→DEGASSING | 8 | 0.2 | 1280 | 1220 | 120 |
| L | Al→REM→DEGASSING | 8 | 0.3 | 1280 | 1220 | 80 |
| M | Al→REM→DEGASSING | 8 | 0.35 | 1280 | 1220 | 120 |
| N | Al→REM→DEGASSING | 12 | 0.2 | 1280 | 1220 | 120 |
| O | Al→REM→flux* | 6 | 0.2 | 1280 | 1220 | 120 |
| P | Al→DEGASSING→REM | 6 | 0.2 | 1280 | 1220 | 120 |
| Q | Al→flux*→REM→DEGASSING | 6 | 0.2 | 1280 | 1220 | 120 |

TABLE 2A

| STEEL NO. | MANUFACTURING CONDITION CODE | C | Si | Mn | P | S | Al | Ca | REM | Ti | N | O |
|---|---|---|---|---|---|---|---|---|---|---|---|---|
| 5 | F | 0.51 | 0.39 | 0.63 | 0.011 | 0.007 | 0.012 | 0.0022 | 0.0208 | 0.0049 | 0.0122 | 0.0006 |
| 6 | F | 0.55 | 0.03 | 0.38 | 0.013 | 0.006 | 0.039 | 0.0048 | 0.0377 | 0.0023 | 0.0039 | 0.0005 |
| 7 | F | 0.59 | 0.37 | 0.31 | 0.014 | 0.008 | 0.013 | 0.0007 | 0.0002 | 0.0005 | 0.0137 | 0.0022 |
| 8 | F | 0.78 | 0.11 | 0.56 | 0.014 | 0.010 | 0.018 | 0.0015 | 0.0193 | 0.0045 | 0.0039 | 0.0003 |

TABLE 2A-continued

| STEEL NO. | MANUFACTURING CONDITION CODE | C | Si | Mn | P | S | Al | Ca | REM | Ti | N | O |
|---|---|---|---|---|---|---|---|---|---|---|---|---|
| 9 | F | 0.46 | 0.52 | 0.41 | 0.012 | 0.007 | 0.030 | 0.0043 | 0.0324 | 0.0006 | 0.0064 | 0.0019 |
| 10 | F | 0.82 | 0.66 | 0.53 | 0.013 | 0.005 | 0.031 | 0.0012 | 0.0015 | 0.0005 | 0.0031 | 0.0028 |
| 11 | F | 0.51 | 0.02 | 0.70 | 0.011 | 0.008 | 0.045 | 0.0006 | 0.0389 | 0.0028 | 0.0060 | 0.0009 |
| 12 | F | 0.59 | 0.55 | 0.46 | 0.013 | 0.009 | 0.017 | 0.0045 | 0.0098 | 0.0023 | 0.0110 | 0.0023 |
| 13 | F | 0.56 | 0.15 | 0.34 | 0.013 | 0.010 | 0.036 | 0.0008 | 0.0074 | 0.0033 | 0.0098 | 0.0006 |
| 14 | F | 0.52 | 0.50 | 0.30 | 0.013 | 0.008 | 0.041 | 0.0041 | 0.0265 | 0.0027 | 0.0064 | 0.0010 |
| 15 | F | 0.54 | 0.62 | 1.20 | 0.013 | 0.006 | 0.029 | 0.0025 | 0.0481 | 0.0023 | 0.0025 | 0.0005 |
| 16 | F | 0.49 | 0.26 | 0.98 | 0.014 | 0.005 | 0.027 | 0.0036 | 0.0441 | 0.0024 | 0.0024 | 0.0011 |
| 17 | F | 0.56 | 0.36 | 0.39 | 0.014 | 0.006 | 0.036 | 0.0017 | 0.0419 | 0.0003 | 0.0104 | 0.0025 |
| 18 | F | 0.58 | 0.49 | 0.75 | 0.014 | 0.005 | 0.030 | 0.0031 | 0.0340 | 0.0024 | 0.0038 | 0.0003 |
| 19 | F | 0.49 | 0.28 | 0.53 | 0.014 | 0.005 | 0.021 | 0.0048 | 0.0417 | 0.0019 | 0.0051 | 0.0005 |
| 20 | F | 0.58 | 0.21 | 0.61 | 0.014 | 0.007 | 0.029 | 0.0034 | 0.0071 | 0.0026 | 0.0033 | 0.0003 |
| 21 | F | 0.51 | 0.60 | 0.49 | 0.012 | 0.008 | 0.050 | 0.0039 | 0.0182 | 0.0045 | 0.0074 | 0.0023 |
| 22 | F | 0.52 | 0.55 | 0.79 | 0.011 | 0.006 | 0.016 | 0.0022 | 0.0347 | 0.0021 | 0.0032 | 0.0004 |
| 23 | F | 0.53 | 0.19 | 0.58 | 0.013 | 0.009 | 0.044 | 0.0026 | 0.0326 | 0.0037 | 0.0111 | 0.0010 |
| 24 | F | 0.52 | 0.19 | 0.42 | 0.012 | 0.008 | 0.040 | 0.0049 | 0.0361 | 0.0035 | 0.0088 | 0.0003 |
| 25 | K | 0.58 | 0.17 | 0.70 | 0.011 | 0.008 | 0.032 | — | 0.0412 | 0.0024 | 0.0129 | 0.0010 |
| 26 | K | 0.56 | 0.09 | 0.40 | 0.012 | 0.009 | 0.028 | — | 0.0369 | 0.0031 | 0.0125 | 0.0020 |
| 27 | K | 0.55 | 0.69 | 0.67 | 0.010 | 0.009 | 0.044 | — | 0.0241 | 0.0048 | 0.0067 | 0.0009 |
| 28 | K | 0.56 | 0.39 | 0.76 | 0.011 | 0.006 | 0.012 | — | 0.0331 | 0.0047 | 0.0131 | 0.0028 |
| 29 | K | 0.51 | 0.34 | 0.55 | 0.015 | 0.006 | 0.017 | — | 0.0265 | 0.0022 | 0.0035 | 0.0025 |
| 30 | K | 0.50 | 0.16 | 0.71 | 0.011 | 0.008 | 0.042 | — | 0.0191 | 0.0011 | 0.0079 | 0.0029 |
| 31 | K | 0.48 | 0.74 | 0.50 | 0.010 | 0.008 | 0.029 | — | 0.0067 | 0.0024 | 0.0070 | 0.0024 |
| 32 | K | 0.60 | 0.05 | 0.71 | 0.015 | 0.007 | 0.023 | — | 0.0484 | 0.0016 | 0.0045 | 0.0002 |
| 33 | K | 0.56 | 0.37 | 0.36 | 0.012 | 0.008 | 0.049 | — | 0.0140 | 0.0033 | 0.0144 | 0.0024 |
| 34 | K | 0.60 | 0.65 | 0.35 | 0.010 | 0.008 | 0.049 | — | 0.0003 | 0.0012 | 0.0056 | 0.0017 |
| 35 | K | 0.54 | 0.34 | 0.61 | 0.015 | 0.010 | 0.050 | — | 0.0266 | 0.0003 | 0.0149 | 0.0003 |
| 36 | K | 0.52 | 0.29 | 0.55 | 0.011 | 0.008 | 0.011 | — | 0.0443 | 0.0048 | 0.0081 | 0.0003 |
| 37 | K | 0.52 | 0.16 | 0.71 | 0.011 | 0.008 | 0.022 | — | 0.0271 | 0.0028 | 0.0141 | 0.0020 |
| 38 | N | 0.65 | 0.25 | 0.75 | 0.007 | 0.009 | 0.025 | — | 0.0390 | 0.0010 | 0.0050 | 0.0005 |
| 39 | J | 0.72 | 0.24 | 0.73 | 0.007 | 0.003 | 0.023 | — | 0.0011 | 0.0011 | 0.0040 | 0.0005 |
| 40 | M | 0.85 | 0.24 | 0.76 | 0.008 | 0.008 | 0.038 | — | 0.0055 | 0.0012 | 0.0060 | 0.0003 |
| 41 | L | 0.63 | 0.26 | 0.75 | 0.008 | 0.008 | 0.024 | — | 0.0110 | 0.0010 | 0.0050 | 0.0004 |
| 42 | O | 0.72 | 0.25 | 0.75 | 0.007 | 0.001 | 0.025 | 0.0020 | 0.0020 | 0.0025 | 0.0050 | 0.0005 |
| 43 | K | 0.65 | 0.24 | 1.10 | 0.007 | 0.009 | 0.025 | — | 0.0150 | 0.0009 | 0.0050 | 0.0003 |
| 44 | K | 0.59 | 0.79 | 0.53 | 0.010 | 0.008 | 0.039 | — | 0.0468 | 0.0021 | 0.0150 | 0.0024 |
| 45 | K | 0.59 | 0.09 | 0.65 | 0.013 | 0.009 | 0.033 | — | 0.0281 | 0.0026 | 0.0116 | 0.0018 |
| 46 | K | 0.49 | 0.69 | 0.59 | 0.013 | 0.009 | 0.044 | — | 0.0378 | 0.0012 | 0.0095 | 0.0013 |
| 47 | J | 0.51 | 0.33 | 0.59 | 0.011 | 0.007 | 0.047 | — | 0.0025 | 0.0007 | 0.0050 | 0.0005 |
| 48 | J | 0.55 | 0.79 | 0.47 | 0.013 | 0.008 | 0.013 | — | 0.0033 | 0.0008 | 0.0040 | 0.0005 |
| 51 | F | 0.57 | 0.80 | 0.39 | 0.010 | 0.009 | 0.049 | 0.0025 | 0.0437 | 0.0039 | 0.0144 | 0.0007 |

TABLE 2B

| STEEL NO. | MANUFACTURING CONDITION CODE | Cr | V | Mo | W | Ni | Cu | Nb | B | CASTING RESULTS | REMARK |
|---|---|---|---|---|---|---|---|---|---|---|---|
| 5 | F | 0.14 | — | — | — | — | — | — | — | COMPLETED | PRESENT EXAMPLE |
| 6 | F | 0.11 | — | — | — | — | — | — | — | COMPLETED | PRESENT EXAMPLE |
| 7 | F | 0.09 | — | — | — | — | — | — | — | COMPLETED | PRESENT EXAMPLE |
| 8 | F | 0.08 | — | — | — | — | — | — | — | COMPLETED | PRESENT EXAMPLE |
| 9 | F | 0.02 | — | — | — | — | — | — | — | COMPLETED | PRESENT EXAMPLE |
| 10 | F | 0.05 | — | — | — | — | — | — | — | COMPLETED | PRESENT EXAMPLE |
| 11 | F | 0.20 | — | — | — | — | — | — | — | COMPLETED | PRESENT EXAMPLE |
| 12 | F | 0.07 | — | — | — | — | — | — | — | COMPLETED | PRESENT EXAMPLE |
| 13 | F | — | — | — | — | — | — | — | — | COMPLETED | PRESENT EXAMPLE |
| 14 | F | 0.14 | — | — | — | — | — | — | — | COMPLETED | PRESENT EXAMPLE |
| 15 | F | — | — | — | — | — | — | — | — | COMPLETED | PRESENT EXAMPLE |
| 16 | F | 0.20 | — | — | — | — | — | — | — | COMPLETED | PRESENT EXAMPLE |
| 17 | F | 0.70 | — | — | — | — | — | — | — | COMPLETED | PRESENT EXAMPLE |

TABLE 2B-continued

| STEEL NO. | MANUFACTURING CONDITION CODE | Cr | V | Mo | W | Ni | Cu | Nb | B | CASTING RESULTS | REMARK |
|---|---|---|---|---|---|---|---|---|---|---|---|
| 18 | F | 1.10 | — | — | — | — | — | — | — | COMPLETED | PRESENT EXAMPLE |
| 19 | F | 1.50 | — | — | — | — | — | — | — | COMPLETED | PRESENT EXAMPLE |
| 20 | F | 0.14 | — | — | — | 1.605 | 0.240 | — | — | COMPLETED | PRESENT EXAMPLE |
| 21 | F | 0.19 | — | 0.195 | — | 0.490 | 0.353 | — | — | COMPLETED | PRESENT EXAMPLE |
| 22 | F | 0.12 | 0.242 | — | — | — | — | — | — | COMPLETED | PRESENT EXAMPLE |
| 23 | F | 0.10 | — | — | — | — | — | 0.009 | — | COMPLETED | PRESENT EXAMPLE |
| 24 | F | 0.12 | 0.435 | — | — | — | — | — | — | COMPLETED | PRESENT EXAMPLE |
| 25 | K | 0.11 | 0.463 | — | — | — | — | — | — | COMPLETED | PRESENT EXAMPLE |
| 26 | K | — | — | 0.730 | — | — | — | — | — | COMPLETED | PRESENT EXAMPLE |
| 27 | K | 0.15 | — | 0.297 | — | — | — | — | — | COMPLETED | PRESENT EXAMPLE |
| 28 | K | 0.11 | — | — | 0.254 | — | — | — | — | COMPLETED | PRESENT EXAMPLE |
| 29 | K | 0.14 | — | — | 0.741 | — | — | — | — | COMPLETED | PRESENT EXAMPLE |
| 30 | K | 0.12 | — | — | — | 2.399 | — | — | — | COMPLETED | PRESENT EXAMPLE |
| 31 | K | 0.06 | — | — | — | 0.803 | — | — | — | COMPLETED | PRESENT EXAMPLE |
| 32 | K | 0.06 | — | — | — | — | 0.423 | — | — | COMPLETED | PRESENT EXAMPLE |
| 33 | K | 0.16 | — | — | — | — | 0.132 | — | — | COMPLETED | PRESENT EXAMPLE |
| 34 | K | — | — | — | — | — | — | 0.030 | — | COMPLETED | PRESENT EXAMPLE |
| 35 | K | 0.06 | — | — | — | — | — | 0.021 | — | COMPLETED | PRESENT EXAMPLE |
| 36 | K | 0.08 | — | — | — | — | — | — | 0.001 | COMPLETED | PRESENT EXAMPLE |
| 37 | K | 0.06 | — | — | — | — | — | — | 0.001 | COMPLETED | PRESENT EXAMPLE |
| 38 | N | 1.05 | — | — | — | — | — | — | — | COMPLETED | PRESENT EXAMPLE |
| 39 | J | 1.05 | — | — | — | — | — | — | — | COMPLETED | PRESENT EXAMPLE |
| 40 | M | 1.04 | — | — | — | — | — | — | — | COMPLETED | PRESENT EXAMPLE |
| 41 | L | 1.05 | — | — | — | — | — | — | — | COMPLETED | PRESENT EXAMPLE |
| 42 | O | 1.05 | — | — | — | — | — | — | — | COMPLETED | PRESENT EXAMPLE |
| 43 | K | 1.05 | — | — | — | — | — | — | — | COMPLETED | PRESENT EXAMPLE |
| 44 | K | 0.13 | — | — | — | — | — | — | — | COMPLETED | PRESENT EXAMPLE |
| 45 | K | 0.18 | — | — | — | — | — | — | — | COMPLETED | PRESENT EXAMPLE |
| 46 | K | 0.12 | — | — | — | — | — | — | — | COMPLETED | PRESENT EXAMPLE |
| 47 | J | — | — | — | — | — | — | — | — | COMPLETED | PRESENT EXAMPLE |
| 48 | J | — | — | — | — | — | — | — | — | COMPLETED | PRESENT EXAMPLE |
| 51 | F | — | — | — | — | — | — | — | — | COMPLETED | PRESENT EXAMPLE |

TABLE 3A

| STEEL NO. | MANUFACTURING CONDITION CODE | STATE OF MOST ABUNDANT INCLUSIONS | NUMBER FRACTION OF COMPOSITE INCLUSION TO WHICH TiN ADHERES WITH RESPECT TO TOTAL INCLUSIONS (%) |
|---|---|---|---|
| 5 | F | REM-Ca—Al—O—S—(TiN) | 75.9 |
| 6 | F | REM-Ca—Al—O—S—(TiN) | 91.0 |

TABLE 3A-continued

| STEEL NO. | MANUFACTURING CONDITION CODE | STATE OF MOST ABUNDANT INCLUSIONS | NUMBER FRACTION OF COMPOSITE INCLUSION TO WHICH TiN ADHERES WITH RESPECT TO TOTAL INCLUSIONS (%) |
|---|---|---|---|
| 7 | F | REM-Ca—Al—O—S—(TiN) | 74.6 |
| 8 | F | REM-Ca—Al—O—S—(TiN) | 86.6 |
| 9 | F | REM-Ca—Al—O—S—(TiN) | 87.8 |
| 10 | F | REM-Ca—Al—O—S—(TiN) | 75.7 |
| 11 | F | REM-Ca—Al—O—S—(TiN) | 71.0 |
| 12 | F | REM-Ca—Al—O—S—(TiN) | 79.9 |
| 13 | F | REM-Ca—Al—O—S—(TiN) | 73.8 |
| 14 | F | REM-Ca—Al—O—S—(TiN) | 93.9 |
| 15 | F | REM-Ca—Al—O—S—(TiN) | 73.6 |
| 16 | F | REM-Ca—Al—O—S—(TiN) | 74.0 |
| 17 | F | REM-Ca—Al—O—S—(TiN) | 82.3 |
| 18 | F | REM-Ca—Al—O—S—(TiN) | 71.4 |
| 19 | F | REM-Ca—Al—O—S—(TiN) | 91.5 |
| 20 | F | REM-Ca—Al—O—S—(TiN) | 93.2 |
| 21 | F | REM-Ca—Al—O—S—(TiN) | 80.9 |
| 22 | F | REM-Ca—Al—O—S—(TiN) | 94.7 |
| 23 | F | REM-Ca—Al—O—S—(TiN) | 71.3 |
| 24 | F | REM-Ca—Al—O—S—(TiN) | 91.5 |
| 25 | K | REM-Al—O—S—(TiN) | 77.8 |
| 26 | K | REM-Al—O—S—(TiN) | 86.2 |
| 27 | K | REM-Al—O—S—(TiN) | 74.7 |
| 28 | K | REM-Al—O—S—(TiN) | 75.2 |
| 29 | K | REM-Al—O—S—(TiN) | 89.3 |
| 30 | K | REM-Al—O—S—(TiN) | 85.9 |
| 31 | K | REM-Al—O—S—(TiN) | 90.7 |
| 32 | K | REM-Al—O—S—(TiN) | 89.9 |
| 33 | K | REM-Al—O—S—(TiN) | 94.8 |
| 34 | K | REM-Al—O—S—(TiN) | 93.2 |
| 35 | K | REM-Al—O—S—(TiN) | 78.0 |
| 36 | K | REM-Al—O—S—(TiN) | 81.4 |
| 37 | K | REM-Al—O—S—(TiN) | 86.2 |
| 38 | N | REM-Ca—Al—O—S—(TiN) | 76.8 |
| 39 | J | REM-Al—O—S—(TiN) | 92.8 |
| 40 | M | REM-Al—O—S—(TiN) | 77.7 |
| 41 | L | REM-Al—O—S—(TiN) | 73.4 |
| 42 | O | REM-Al—O—S—(TiN) | 89.9 |
| 43 | K | REM-Al—O—S—(TiN) | 86.9 |
| 44 | K | REM-Al—O—S—(TiN) | 82.5 |
| 45 | K | REM-Al—O—S—(TiN) | 75.9 |
| 46 | K | REM-Al—O—S—(TiN) | 90.5 |
| 47 | J | REM-Al—O—S—(TiN) | 55.4 |
| 48 | J | REM-Al—O—S—(TiN) | 52.3 |
| 51 | F | REM-Ca—Al—O—S—(TiN) | 89.5 |

TABLE 3B

| STEEL NO. | MANUFACTURING CONDITION CODE | SUM OF NUMBER DENSITY OF TiN HAVING MAXIMUM DIAMETER OF 1 μm OR MORE WHICH INDEPENDENTLY EXISTS WITHOUT ADHESION TO INCLUSION AND NUMBER DENSITY OF MnS HAVING MAXIMUM DIAMETER OF 10 μm OR MORE (PIECES/mm$^2$) | FATIGUE PROPERTIES $L_{10}$(×10$^6$) (CYCLES) | 180° C. TEMPERING VICKERS HARDNESS (Hv) | REMARK |
|---|---|---|---|---|---|
| 5 | F | 0.09 | 17.9 | 693.5 | PRESENT EXAMPLE |
| 6 | F | 0.02 | 16.6 | 702.4 | PRESENT EXAMPLE |
| 7 | F | 0.04 | 17.9 | 705.0 | PRESENT EXAMPLE |
| 8 | F | 0.04 | 18.4 | 703.1 | PRESENT EXAMPLE |
| 9 | F | 0.06 | 19.7 | 690.4 | PRESENT EXAMPLE |
| 10 | F | 0.06 | 19.6 | 700.3 | PRESENT EXAMPLE |
| 11 | F | 0.03 | 16.5 | 719.5 | PRESENT EXAMPLE |
| 12 | F | 0.03 | 17.6 | 707.4 | PRESENT EXAMPLE |
| 13 | F | 0.06 | 17.3 | 709.8 | PRESENT EXAMPLE |
| 14 | F | 0.04 | 18.9 | 693.2 | PRESENT EXAMPLE |
| 15 | F | 0.02 | 19.3 | 697.0 | PRESENT EXAMPLE |
| 16 | F | 0.08 | 17.9 | 695.6 | PRESENT EXAMPLE |
| 17 | F | 0.07 | 17.8 | 703.6 | PRESENT EXAMPLE |
| 18 | F | 0.02 | 18.8 | 692.9 | PRESENT EXAMPLE |
| 19 | F | 0.03 | 18.0 | 711.9 | PRESENT EXAMPLE |
| 20 | F | 0.07 | 17.1 | 713.7 | PRESENT EXAMPLE |
| 21 | F | 0.07 | 17.5 | 706.4 | PRESENT EXAMPLE |
| 22 | F | 0.07 | 18.4 | 703.9 | PRESENT EXAMPLE |

TABLE 3B-continued

| STEEL NO. | MANUFACTURING CONDITION CODE | SUM OF NUMBER DENSITY OF TiN HAVING MAXIMUM DIAMETER OF 1 μm OR MORE WHICH INDEPENDENTLY EXISTS WITHOUT ADHESION TO INCLUSION AND NUMBER DENSITY OF MnS HAVING MAXIMUM DIAMETER OF 10 μm OR MORE (PIECES/mm$^2$) | FATIGUE PROPERTIES $L_{10}$(×10$^6$) (CYCLES) | 180° C. TEMPERING VICKERS HARDNESS (Hv) | REMARK |
|---|---|---|---|---|---|
| 23 | F | 0.07 | 16.7 | 719.9 | PRESENT EXAMPLE |
| 24 | F | 0.04 | 16.4 | 718.2 | PRESENT EXAMPLE |
| 25 | K | 0.06 | 17.1 | 719.6 | PRESENT EXAMPLE |
| 26 | K | 0.04 | 17.6 | 694.6 | PRESENT EXAMPLE |
| 27 | K | 0.09 | 19.3 | 705.1 | PRESENT EXAMPLE |
| 28 | K | 0.06 | 17.5 | 705.1 | PRESENT EXAMPLE |
| 29 | K | 0.09 | 16.6 | 693.2 | PRESENT EXAMPLE |
| 30 | K | 0.08 | 19.1 | 705.9 | PRESENT EXAMPLE |
| 31 | K | 0.02 | 18.4 | 696.7 | PRESENT EXAMPLE |
| 32 | K | 0.04 | 17.5 | 714.7 | PRESENT EXAMPLE |
| 33 | K | 0.04 | 17.4 | 705.9 | PRESENT EXAMPLE |
| 34 | K | 0.06 | 17.1 | 718.4 | PRESENT EXAMPLE |
| 35 | K | 0.03 | 16.2 | 695.0 | PRESENT EXAMPLE |
| 36 | K | 0.06 | 16.6 | 716.7 | PRESENT EXAMPLE |
| 37 | K | 0.09 | 16.4 | 690.5 | PRESENT EXAMPLE |
| 38 | N | 0.08 | 16.4 | 693.4 | PRESENT EXAMPLE |
| 39 | J | 0.06 | 18.5 | 717.9 | PRESENT EXAMPLE |
| 40 | M | 0.09 | 19.8 | 701.0 | PRESENT EXAMPLE |
| 41 | L | 0.09 | 19.8 | 718.1 | PRESENT EXAMPLE |
| 42 | O | 0.05 | 20.0 | 710.0 | PRESENT EXAMPLE |
| 43 | K | 0.07 | 19.2 | 701.4 | PRESENT EXAMPLE |
| 44 | K | 0.07 | 19.5 | 694.5 | PRESENT EXAMPLE |
| 45 | K | 0.07 | 18.0 | 709.8 | PRESENT EXAMPLE |
| 46 | K | 0.05 | 17.6 | 712.9 | PRESENT EXAMPLE |
| 47 | J | 1.13 | 11.3 | 731.5 | PRESENT EXAMPLE |
| 48 | J | 1.33 | 11.8 | 739.6 | PRESENT EXAMPLE |
| 51 | F | 0.10 | 19.7 | 712.3 | PRESENT EXAMPLE |

TABLE 4A

| STEEL NO. | MANUFACTURING CONDITION CODE | C | Si | Mn | P | S | Al | Ca | REM | Ti | N | O |
|---|---|---|---|---|---|---|---|---|---|---|---|---|
| 52 | B | 0.60 | 0.13 | 0.49 | 0.013 | 0.009 | 0.029 | 0.0008 | 0.0020 | 0.0005 | 0.005 | 0.0005 |
| 53 | E | 0.48 | 0.43 | 0.59 | 0.013 | 0.007 | 0.013 | 0.0010 | 0.0030 | 0.0080 | 0.007 | 0.0004 |
| 54 | A | 0.57 | 0.33 | 0.51 | 0.011 | 0.008 | 0.024 | 0.0011 | 0.00007 | 0.0008 | 0.005 | 0.0005 |
| 55 | — | 0.52 | 0.23 | 0.65 | 0.014 | 0.007 | 0.044 | 0.0011 | 0.0630 | 0.0017 | 0.005 | 0.0005 |
| 56 | P | 0.48 | 0.46 | 0.45 | 0.013 | 0.007 | 0.018 | 0.0013 | 0.0013 | 0.0045 | 0.003 | 0.0001 |
| 57 | I | 0.56 | 0.15 | 0.69 | 0.011 | 0.008 | 0.037 | 0.0032 | 0.0442 | 0.0016 | 0.015 | 0.0028 |
| 58 | Q | 0.58 | 0.14 | 0.43 | 0.012 | 0.009 | 0.045 | 0.0021 | 0.0313 | 0.0015 | 0.005 | 0.0004 |
| 59 | F | 0.53 | 0.79 | 0.38 | 0.011 | 0.051 | 0.045 | 0.0025 | 0.0261 | 0.0029 | 0.011 | 0.0009 |
| 60 | F | 0.58 | 0.45 | 0.51 | 0.014 | 0.007 | 0.020 | 0.0051 | 0.0453 | 0.0041 | 0.012 | 0.0013 |
| 61 | A | 0.57 | 0.57 | 0.43 | 0.012 | 0.008 | 0.043 | 0.0059 | 0.0292 | 0.0034 | 0.008 | 0.0027 |
| 62 | C | 0.53 | 0.64 | 0.63 | 0.013 | 0.006 | 0.037 | 0.0036 | 0.0255 | 0.0026 | 0.009 | 0.0030 |
| 63 | D | 0.55 | 0.65 | 0.62 | 0.015 | 0.008 | 0.031 | 0.0008 | 0.0020 | 0.0005 | 0.005 | 0.0005 |
| 64 | F | 0.15 | 0.11 | 0.73 | 0.015 | 0.009 | 0.023 | 0.0026 | 0.0295 | 0.0041 | 0.008 | 0.0006 |
| 65 | F | 1.52 | 0.50 | 0.41 | 0.014 | 0.010 | 0.016 | 0.0013 | 0.0175 | 0.0023 | 0.011 | 0.0016 |
| 66 | F | 0.49 | 0.007 | 0.79 | 0.013 | 0.006 | 0.025 | 0.0030 | 0.0077 | 0.0001 | 0.012 | 0.0010 |
| 67 | F | 0.53 | 0.82 | 0.64 | 0.012 | 0.006 | 0.037 | 0.0008 | 0.0014 | 0.0015 | 0.006 | 0.0024 |
| 68 | F | 0.50 | 0.55 | 0.08 | 0.011 | 0.008 | 0.025 | 0.0015 | 0.0173 | 0.0042 | 0.004 | 0.0012 |
| 69 | F | 0.59 | 0.26 | 1.52 | 0.012 | 0.008 | 0.015 | 0.0050 | 0.0481 | 0.0011 | 0.002 | 0.0020 |
| 70 | F | 0.53 | 0.15 | 0.48 | 0.032 | 0.010 | 0.029 | 0.0018 | 0.0073 | 0.0006 | 0.009 | 0.0018 |
| 71 | F | 0.54 | 0.66 | 0.36 | 0.011 | 0.006 | 0.044 | 0.0017 | 0.0382 | 0.0033 | 0.002 | 0.0010 |
| 72 | F | 0.52 | 0.69 | 0.70 | 0.010 | 0.007 | 0.008 | 0.0022 | 0.0008 | 0.0036 | 0.007 | 0.0026 |
| 73 | F | 0.50 | 0.07 | 0.43 | 0.011 | 0.008 | 0.052 | 0.0039 | 0.0203 | 0.0008 | 0.006 | 0.0019 |
| 74 | F | 0.50 | 0.66 | 0.71 | 0.014 | 0.009 | 0.033 | 0.0044 | 0.0298 | 0.0031 | 0.016 | 0.0010 |
| 75 | F | 0.53 | 0.03 | 0.42 | 0.015 | 0.006 | 0.050 | 0.0033 | 0.0352 | 0.0031 | 0.015 | 0.00008 |
| 76 | F | 0.52 | 0.62 | 0.76 | 0.012 | 0.010 | 0.017 | 0.0010 | 0.0014 | 0.0002 | 0.012 | 0.0032 |
| 78 | F | 0.54 | 0.75 | 0.72 | 0.011 | 0.010 | 0.016 | 0.0033 | 0.0418 | 0.0019 | 0.011 | 0.0013 |
| 79 | F | 0.55 | 0.50 | 0.49 | 0.012 | 0.008 | 0.032 | 0.0025 | 0.0233 | 0.0028 | 0.004 | 0.0023 |
| 81 | F | 0.58 | 0.42 | 0.41 | 0.011 | 0.010 | 0.025 | 0.0043 | 0.0087 | 0.0045 | 0.005 | 0.0030 |
| 82 | F | 0.51 | 0.08 | 0.76 | 0.011 | 0.007 | 0.046 | 0.0019 | 0.0138 | 0.0048 | 0.015 | 0.0025 |
| 83 | F | 0.57 | 0.10 | 0.76 | 0.011 | 0.006 | 0.050 | 0.0024 | 0.0188 | 0.0004 | 0.004 | 0.0010 |

* STEEL NUMBER 55 WAS INTENDED TO BE MANUFACTURED UNDER THE CONDITION A, BUT CASTING WAS IMPOSSIBLE DUE TO CLOGGING OF A CASTING NOZZLE

TABLE 4B

| STEEL NO. | MANUFACTURING CONDITION CODE | Cr | V | Mo | W | Ni | Cu | Nb | B | CASTING RESULTS | REMARK |
|---|---|---|---|---|---|---|---|---|---|---|---|
| 52 | B | — | — | — | — | — | — | — | — | COMPLETED | COMPARATIVE EXAMPLE |
| 53 | E | — | — | — | — | — | — | — | — | COMPLETED | COMPARATIVE EXAMPLE |
| 54 | A | — | — | — | — | — | — | — | — | COMPLETED | COMPARATIVE EXAMPLE |
| 55 | — | — | — | — | — | — | — | — | — | STOPPED DUE TO NOZZLE CLOGGING | COMPARATIVE EXAMPLE |
| 56 | P | — | — | — | — | — | — | — | — | COMPLETED | COMPARATIVE EXAMPLE |
| 57 | I | — | — | — | — | — | — | — | — | COMPLETED | COMPARATIVE EXAMPLE |
| 58 | Q | — | — | — | — | — | — | — | — | COMPLETED | COMPARATIVE EXAMPLE |
| 59 | F | — | — | — | — | — | — | — | — | COMPLETED | COMPARATIVE EXAMPLE |
| 60 | F | — | — | — | — | — | — | — | — | COMPLETED | COMPARATIVE EXAMPLE |
| 61 | A | — | — | — | — | — | — | — | — | COMPLETED | COMPARATIVE EXAMPLE |
| 62 | C | — | — | — | — | — | — | — | — | COMPLETED | COMPARATIVE EXAMPLE |
| 63 | D | — | — | — | — | — | — | — | — | COMPLETED | COMPARATIVE EXAMPLE |
| 64 | F | — | — | — | — | — | — | — | — | COMPLETED | COMPARATIVE EXAMPLE |
| 65 | F | — | — | — | — | — | — | — | — | COMPLETED | COMPARATIVE EXAMPLE |
| 66 | F | — | — | — | — | — | — | — | — | COMPLETED | COMPARATIVE EXAMPLE |
| 67 | F | — | — | — | — | — | — | — | — | COMPLETED | COMPARATIVE EXAMPLE |
| 68 | F | — | — | — | — | — | — | — | — | COMPLETED | COMPARATIVE EXAMPLE |
| 69 | F | — | — | — | — | — | — | — | — | COMPLETED | COMPARATIVE EXAMPLE |
| 70 | F | — | — | — | — | — | — | — | — | COMPLETED | COMPARATIVE EXAMPLE |
| 71 | F | 2.22 | — | — | — | — | — | — | — | COMPLETED | COMPARATIVE EXAMPLE |
| 72 | F | — | — | — | — | — | — | — | — | COMPLETED | COMPARATIVE EXAMPLE |
| 73 | F | — | — | — | — | — | — | — | — | COMPLETED | COMPARATIVE EXAMPLE |
| 74 | F | — | — | — | — | — | — | — | — | COMPLETED | COMPARATIVE EXAMPLE |
| 75 | F | — | — | — | — | — | — | — | — | COMPLETED | COMPARATIVE EXAMPLE |
| 76 | F | — | — | — | — | — | — | — | — | COMPLETED | COMPARATIVE EXAMPLE |
| 78 | F | — | — | 1.02 | — | — | — | — | — | COMPLETED | COMPARATIVE EXAMPLE |
| 79 | F | — | — | — | 1.02 | — | — | — | — | COMPLETED | COMPARATIVE EXAMPLE |
| 81 | F | — | — | — | — | — | 0.52 | — | — | COMPLETED | COMPARATIVE EXAMPLE |
| 82 | F | — | — | — | — | — | — | 0.052 | — | COMPLETED | COMPARATIVE EXAMPLE |
| 83 | F | — | — | — | — | — | — | — | 0.0052 | COMPLETED | COMPARATIVE EXAMPLE |

* STEEL NUMBER 55 WAS INTENDED TO BE MANUFACTURED UNDER THE CONDITION A, BUT CASTING WAS IMPOSSIBLE DUE TO CLOGGING OF A CASTING NOZZLE

TABLE 5A

| STEEL NO. | MANUFACTURING CONDITION CODE | STATE OF MOST ABUNDANT INCLUSIONS | NUMBER FRACTION OF COMPOSITE INCLUSION TO WHICH TiN ADHERES WITH RESPECT TO TOTAL INCLUSIONS (%) |
|---|---|---|---|
| 52 | B | REM-Ca—Al—O—S | 33.4 |
| 53 | E | REM-Ca—Al—O—S—(TiN) | 35.0 |

TABLE 5A-continued

| STEEL NO. | MANUFACTURING CONDITION CODE | STATE OF MOST ABUNDANT INCLUSIONS | NUMBER FRACTION OF COMPOSITE INCLUSION TO WHICH TiN ADHERES WITH RESPECT TO TOTAL INCLUSIONS (%) |
|---|---|---|---|
| 54 | A | Al—Ca—O | 36.2 |
| 55 | — | OCCURRENCE OF NOZZLE CLOGGING | — |
| 56 | P | Al—Ca—O | 48.6 |
| 57 | I | Al—Ca—O, REM-Ca—Al—O—S—(TiN) | 39.3 |
| 58 | Q | REM-Ca—Al—O—S | 43.5 |
| 59 | F | MnS | 42.0 |
| 60 | F | CaO, Al—Ca—O | 35.0 |
| 61 | A | CaO | 33.0 |
| 62 | C | REM-Ca—Al—O—S | 32.0 |
| 63 | D | REM-Ca—Al—O—S | 34.0 |
| 64 | F | REM-Ca—Al—O—S—(TiN) | 72.6 |
| 65 | F | OCCURRENCE OF QUENCHING CRACK | — |
| 66 | F | REM-Ca—Al—O—S—(TiN) | 72.6 |
| 67 | F | OCCURRENCE OF QUENCHING CRACK | — |
| 68 | F | REM-Ca—Al—O—S—(TiN) | 72.6 |
| 69 | F | OCCURRENCE OF QUENCHING CRACK | — |
| 70 | F | REM-Ca—Al—O—S—(TiN) | 72.6 |
| 71 | F | OCCURRENCE OF QUENCHING CRACK | — |
| 72 | F | REM-Ca—O—S | 36.0 |
| 73 | F | $Al_2O_3$, Al—Ca—O | 37.0 |
| 74 | F | TiN, REM-Ca—Al—O—S—(TiN) | 33.0 |
| 75 | F | REM-Ca—Al—S | 35.0 |
| 76 | F | $Al_2O_3$, REM-Ca—Al—O—S—(TiN) | 36.0 |
| 78 | F | OCCURRENCE OF CRACK DURING PROCESSING | — |
| 79 | F | OCCURRENCE OF CRACK DURING PROCESSING | — |
| 81 | F | OCCURRENCE OF CRACK DURING PROCESSING | — |
| 82 | F | OCCURRENCE OF CRACK DURING PROCESSING | — |
| 83 | F | OCCURRENCE OF CRACK DURING PROCESSING | — |

TABLE 5B

| STEEL NO. | MANUFACTURING CONDITION CODE | SUM OF NUMBER DENSITY OF TiN HAVING MAXIMUM DIAMETER OF 1 μm OR MORE WHICH INDEPENDENTLY EXISTS WITHOUT ADHESION TO INCLUSION AND NUMBER DENSITY OF MnS HAVING MAXIMUM DIAMETER OF 10 μm OR MORE (PIECES/$mm^2$) | FATIGUE PROPERTIES $L_{10}(\times 10^6)$ (CYCLES) | 180° C. TEMPERING VICKERS HARDNESS (Hv) | REMARK |
|---|---|---|---|---|---|
| 52 | B | 8.03 | 4.9 | 728.1 | COMPARATIVE EXAMPLE |
| 53 | E | 7.95 | 5.8 | 714.4 | COMPARATIVE EXAMPLE |
| 54 | A | 6.34 | 3.7 | 706.5 | COMPARATIVE EXAMPLE |
| 55 | — | — | — | — | COMPARATIVE EXAMPLE |
| 56 | P | 12.46 | 4.1 | 739.0 | COMPARATIVE EXAMPLE |
| 57 | I | 9.14 | 6.2 | 722.6 | COMPARATIVE EXAMPLE |
| 58 | Q | 9.56 | 7.5 | 734.6 | COMPARATIVE EXAMPLE |
| 59 | F | 7.10 | 8.3 | 660.0 | COMPARATIVE EXAMPLE |
| 60 | F | 11.50 | 8.5 | 660.0 | COMPARATIVE EXAMPLE |
| 61 | A | 7.93 | 5.6 | 722.3 | COMPARATIVE EXAMPLE |
| 62 | C | 8.02 | 5.0 | 720.0 | COMPARATIVE EXAMPLE |
| 63 | D | 11.02 | 5.1 | 720.0 | COMPARATIVE EXAMPLE |
| 64 | F | 0.10 | 8.0 | 590.0 | COMPARATIVE EXAMPLE |
| 65 | F | — | — | — | COMPARATIVE EXAMPLE |
| 66 | F | 0.10 | 7.8 | 580.0 | COMPARATIVE EXAMPLE |
| 67 | F | — | — | — | COMPARATIVE EXAMPLE |
| 68 | F | 0.10 | 7.7 | 585.0 | COMPARATIVE EXAMPLE |
| 69 | F | — | — | — | COMPARATIVE EXAMPLE |
| 70 | F | 0.10 | 7.9 | 697.6 | COMPARATIVE EXAMPLE |
| 71 | F | — | — | — | COMPARATIVE EXAMPLE |
| 72 | F | 10.50 | 6.3 | 697.6 | COMPARATIVE EXAMPLE |
| 73 | F | 9.40 | 6.5 | 697.6 | COMPARATIVE EXAMPLE |
| 74 | F | 8.56 | 6.3 | 697.6 | COMPARATIVE EXAMPLE |
| 75 | F | 7.58 | 6.3 | 697.6 | COMPARATIVE EXAMPLE |
| 76 | F | 11.02 | 6.4 | 697.6 | COMPARATIVE EXAMPLE |
| 78 | F | — | — | — | COMPARATIVE EXAMPLE |
| 79 | F | — | — | — | COMPARATIVE EXAMPLE |
| 81 | F | — | — | — | COMPARATIVE EXAMPLE |
| 82 | F | — | — | — | COMPARATIVE EXAMPLE |
| 83 | F | — | — | — | COMPARATIVE EXAMPLE |

INDUSTRIAL APPLICABILITY

According to the invention, the Al—O-based inclusion is reformed into the REM-Al—O—S-based inclusion, or the Al—Ca—O-based inclusion is reformed into the REM-Ca—Al—O—S-based inclusion, and thus it is possible to prevent stretching or coarsening of an oxide-based inclusion. In addition, TiN is formed a composite with the REM-Al—O—S-based inclusion or the REM-Ca—Al—O—S-based inclusion, and thus it is possible to reduce a number density of TiN which independently exists without adhesion to the composite inclusion. In addition, S is fixed and thus generation of coarse MnS can be suppressed and thus it is possible to provide steel for induction hardening with excellent fatigue properties. Accordingly, it can be said that the industrial applicability of the invention is high.

BRIEF DESCRIPTION OF THE REFERENCE SYMBOLS

A: REM-Ca—Al—O—S-BASED INCLUSION
B: TiN
C: PRO-EUTECTOID CEMENTITE
D: MnS

The invention claimed is:

1. A steel for induction hardening, comprising as a chemical composition, by mass%:
C: 0.45% to 0.85%;
Si: 0.01% to 0.80%;
Mn: 0.1% to 1.5%;
Al: 0.01% to 0.05%;
REM: 0.0001% to 0.050%;
O: 0.0001% to 0.0030%;
Ti: less than 0.005%;
N: 0.015% or less;
P: 0.03% or less;
S: 0.01% or less; and
the balance comprising Fe and impurities,
wherein the steel for induction hardening includes a composite inclusion which is an inclusion containing REM, O, S, and Al, to which TiN is adhered, and
the sum of a number density of TiN having a maximum diameter of 1 μm or more which independently exists without adhesion to the inclusion, and a number density of MnS having a maximum diameter of 10 μm or more is 5 pieces/$mm^2$ or less.

2. A steel for induction hardening, comprising as a chemical composition, by mass %:
C: 0.45% to 0.85%;
Si: 0.01% to 0.80%;
Mn: 0.1% to 1.5%;
Al: 0.01% to 0.05%;
Ca: 0.0050% or less;
REM: 0.0001% to 0.050%;
O: 0.0001% to 0.0030%;
Ti: less than 0.005%;
N: 0.015% or less;
P: 0.03% or less;
S: 0.01% or less; and
the balance comprising Fe and impurities,
wherein the steel for induction hardening includes a composite inclusion which is an inclusion containing REM, Ca, O, S, and Al, to which TiN is adhered, and
the sum of a number density of TiN having a maximum diameter of 1 μm or more which independently exists without adhesion to the inclusion, and a number density of MnS having a maximum diameter of 10 μm or more is 5 pieces/$mm^2$ or less.

3. The steel for induction hardening according to claim 1 or 2, further comprising as the chemical composition, one or more kinds of elements selected from the group consisting of, by mass %:
Cr: 2.0% or less;
V: 0.70% or less;
Mo: 1.00% or less;
W: 1.00% or less;
Ni: 3.50% or less;
Cu: 0.50% or less;
Nb: less than 0.050%; and
B: 0.0050% or less.

* * * * *